US007319442B2

(12) United States Patent
Nakamura et al.

(10) Patent No.: US 7,319,442 B2
(45) **Date of Patent: *Jan. 15, 2008**

(54) DRIVE METHOD AND DRIVE CIRCUIT FOR PLASMA DISPLAY PANEL

(75) Inventors: Tadashi Nakamura, Tokyo (JP); Masahiro Shimizu, Tokyo (JP)

(73) Assignee: Pioneer Corporation, Tokyo (JP)

( * ) Notice: Subject to any disclaimer, the term of this patent is extended or adjusted under 35 U.S.C. 154(b) by 459 days.

This patent is subject to a terminal disclaimer.

(21) Appl. No.: 10/930,950

(22) Filed: Sep. 1, 2004

(65) Prior Publication Data

US 2005/0024296 A1 Feb. 3, 2005

Related U.S. Application Data

(62) Division of application No. 09/536,146, filed on Mar. 28, 2000, now Pat. No. 6,803,888.

(30) Foreign Application Priority Data

Mar. 31, 1999 (JP) ..... 093301/1999

(51) Int. Cl.
*G09G 3/28* (2006.01)

(52) U.S. Cl. ..... 345/60; 345/67; 345/68

(58) Field of Classification Search ..... 345/60–72; 315/169.4; 313/582–587
See application file for complete search history.

(56) References Cited

U.S. PATENT DOCUMENTS 5,446,344 A 8/1995 Kanazawa
5,656,893 A 8/1997 Shino et al.
5,684,499 A 11/1997 Shimizu et al.
5,745,086 A 4/1998 Weber
5,877,734 A 3/1999 Amemiya
6,028,573 A 2/2000 Orita et al.
6,034,482 A 3/2000 Kanazawa et al.
6,236,165 B1 5/2001 Ishizuka
6,803,888 B1 * 10/2004 Nakamura et al. ..... 345/60

FOREIGN PATENT DOCUMENTS

EP 0 488 326 A2 6/1992
EP 0 488 891 A2 6/1992
EP 0 680 067 A2 11/1995
EP 0 829 846 A2 3/1998

(Continued)

*Primary Examiner*—Jimmy H. Nguyen
(74) *Attorney, Agent, or Firm*—Sughrue Mion, PLLC

(57) ABSTRACT

In a drive method of a mixed scan-sustain type of plasma display panel, set-up discharge is performed in the next scan line to be scanned when any particular scan line is in a write period. At this time, a first set-up discharge pulse, which is a gradually rising pulse of the opposite polarity of the scan pulse, is applied to scan electrodes of the scan line that is in the set-up discharge period, and a second set-up discharge pulse, which is a rectangular or gradually rising pulse of the same polarity as the scan pulse and of lower voltage than the scan pulse, is applied to the sustain electrodes. In addition, a set-up discharge erase pulse for eliminating set-up discharge and a sustain erase pulse for eliminating sustain discharge are impressed with the same gradually falling pulse shape.

11 Claims, 17 Drawing Sheets

FOREIGN PATENT DOCUMENTS

| | | |
|---|---|---|
| JP | 4-172392 | 6/1992 |
| JP | 05-241528 | 9/1993 |
| JP | 6- 175607 | 6/1994 |
| JP | 9-6280 | 1/1997 |
| JP | 09-22271 | 1/1997 |
| JP | 09-198004 | 7/1997 |
| JP | 2701725 | 10/1997 |
| JP | 11-15436 | 1/1999 |

* cited by examiner

DRIVE METHOD AND DRIVE CIRCUIT FOR PLASMA DISPLAY PANEL

This is a divisional of application Ser. No. 09/536,146 filed Mar. 28, 2000 now U.S. Pat. No. 6,803,888 the entire disclosure of which is incorporated herein by reference.

BACKGROUND OF THE INVENTION

1. Field of the Invention

The present invention relates to a method of driving a plasma display panel, and particularly to a method of driving an AC plasma display panel.

2. Description of the Related Art

Plasma display panels (hereinbelow abbreviated "PDP") typically offer many features including thin construction, lack of flicker, and a high display contrast ratio, and in addition are relatively amenable to large screen applications. They have a high response speed, and in emissive types can emit color visible lights using phosphors. As a result, plasma display panels increasingly are becoming widely used in recent years in the fields of computer-related display devices and color image display devices.

Depending on the mode of operation, PDP can be divided between an AC type, in which AC discharge occurs indirectly between electrodes that are covered by a dielectric material, and a DC type, in which discharge occurs by exposing electrodes in a discharge space.

The AC type can be further divided between the memory type that takes advantage of the memory effect of the display cells, and the refresh type that does not use the memory effect.

The luminance of the PDP is proportional to the number of discharges, i.e., the number of repeated pulses applied within a prescribed time interval (for example, one frame). Luminance drops as the capacitance of the display increases in the above-described refresh type, and this type is therefore chiefly used for a PDP having a low display capacitance.

The structure of a display cell of the above-described AC memory-type PDP is first described using FIG. 1.

As shown in FIG. 1, a display cell of an AC memory-type PDP is made up of: first insulating substrate 1 and second insulating substrate 2 that are composed of glass and provided on the rear and front surfaces of the panel; transparent scan electrodes 3 and sustain electrodes 4 that are formed on second insulating substrate 2 at a prescribed spacing; first trace electrodes 5 and second trace electrodes 6 that are each laminated so as to overlap over scan electrodes 3 and sustain electrodes 4, respectively, so as to decrease the electrode resistance of scan electrodes 3 and sustain electrodes 4; first dielectric layer 12 that is formed to cover each of scan electrodes 3, sustain electrodes 4, first trace electrodes 5, and second trace electrodes 6; protective layer 13 laminated on first dielectric layer 12 composed of, for example, magnesium oxide, for protecting first dielectric layer 12 from discharges; data electrodes 7 arranged on first insulating substrate 1 and formed in a direction that is orthogonal to scan electrodes 3 and sustain electrodes 4; second dielectric layer 14 formed to cover data electrodes 7; discharge gas space 8 that is formed between first insulating substrate 1 and second insulating substrate 2 and that is filled with a discharge gas composed of an inert gas such as helium, neon, or xenon, or a gas mixture of these gases; barrier ribs 9 provided on second dielectric layer 14 for both forming discharge gas spaces 8 and demarcating discharge cells; and phosphor 11 applied onto second dielectric layer 14 and to the sides of barrier ribs 9 for converting ultra-violet rays generated by discharge in discharge gas space 8 into visible light 10.

In an actual PDP such as a color display panel for VGA, the above-described display cells are arranged in a lattice pattern with 480 display cells in the vertical direction and 1920 display cells in the horizontal direction, 480 scan electrodes 3 and 1920 sustain electrodes 4 being arranged corresponding to these cells.

The discharge in a PDP constructed as shown in FIG. 1 is next explained.

Discharge begins inside the display cell shown in FIG. 1 when a pulse voltage that exceeds the discharge threshold value is applied between scan electrode 3 and data electrode 7, whereupon a positive or negative charge (wall charge) according to the polarity of this pulse voltage is attracted to and accumulated on the surface of first dielectric material 12 and second dielectric material 14.

Since the equivalent internal voltage that is generated as a result of the accumulation of this charge, i.e., the wall voltage, is of the opposite polarity of the applied pulse voltage, the effective voltage inside the cell drops with the growth of discharge. Discharge therefore cannot be sustained and eventually stops even if the above-described pulse voltage is maintained at a fixed value.

Subsequent application of a sustain pulse, which is a pulse voltage of the same polarity as the wall voltage, between scan electrode 3 and sustain electrode 4 causes a build-up in the wall voltage as the effective voltage, which thereby exceeds the discharge threshold value to bring about discharge even if the voltage amplitude of the sustain pulse applied from the outside is small. In other words, discharge is sustained by continuing to apply sustain pulses between scan electrode 3 and sustain electrode 4.

The above-described sustain discharge can be stopped by applying to scan electrode 3 or to sustain electrode 4 a sustain erase pulse, which is a either a wide low-voltage pulse or a narrow pulse of approximately the same voltage as the sustain pulse that serves to neutralize the wall voltage.

As shown in FIG. 2, a PDP is a display panel capable of dot matrix display in which display cells 20 are arranged in a lattice of m rows and n columns. The PDP is provided with scan electrodes Sc1, Sc2, . . . Scm, and sustain electrodes Su1, Su2, . . . , Sum, that are arranged parallel to each other as row electrodes, and data electrodes D1, D2, . . . Dn that are arranged as column electrodes orthogonal to the scan electrodes and sustain electrodes.

When causing any display cell 20 to emit light, scan pulses are sequentially applied to scan electrodes Sc1, Sc2, . . . , Scm, and a data pulse that is in synchronism with the scan pulses is selectively applied to data electrode Di ($1 \leqq i \leqq n$) that is to emit light, thereby applying a voltage that exceeds the discharge threshold value (hereinbelow, referred to as "writing display data"). Emission of light is then sustained by subsequently applying sustain pulses to sustain discharge between scan electrodes Sc1, Sc2, . . . Scm and sustain electrodes Su1, Su2, . . . , Sum.

As shown in FIG. 3, the PDP drive circuit is made up of: scan electrode drive circuit 21 for applying pulse voltages to each of scan electrodes Sc1, Sc2, . . . , Scm; sustain electrode drive circuit 22 for applying pulse voltages to each of sustain electrodes Su1, Su2, . . . , Sum; data electrode drive circuit 23 for applying a voltage in accordance with image signals to each of data electrodes D1, D2, . . . , Dn; and control circuit 24 for outputting control signals to the drive circuit of each electrode based on basic signals (vertical synchronizing signals Vsync, horizontal synchronizing signals Hsync, display data signals DATA, and Clocks).

The vertical synchronizing signals Vsync prescribe the period of one frame; and the horizontal synchronizing signals Hsync are for establishing synchronization in the horizontal direction, similar to the horizontal synchronizing signals that are the control signal of a CRT (Cathode-Ray Tube). The display data signals DATA are signals for prescribing whether each display cell 20 is to emit light or not emit light in accordance with image signals, and the Clocks are signals synchronized with display data signals DATA for causing display data signals DATA to be taken into control circuit 24.

Control circuit 24 is made up of: frame memory 25 for temporarily storing display data signals DATA; memory control unit 26 for reading display data signals DATA from frame memory 25 and transferring display data signals DATA to data electrode drive circuit 23 in accordance with the timing of writing to the PDP; driver control unit 28 for generating a drive waveform that corresponds to the PDP drive sequence and transferring to each of scan electrode drive circuit 21 and sustain electrode drive circuit 22; and signal processing unit 27 for regulating the operation of memory control unit 26 and driver control unit 28 and synchronizing the timing of the operation of each drive circuit.

Drive methods for an AC memory-type PDP include a separate scan-sustain type in which the application of sustain pulses to each scan line begins simultaneously after sequentially writing the display data of one frame (or one sub-field, to be explained hereinbelow) for each scan line, and the mixed scan-sustain type in which display data are sequential written for each scan line while sustain pulses are constantly applied to each display cell.

Referring to FIG. 4, explanation is next presented regarding a prior-art PDP drive method taking the mixed scan-sustain type as an example. The PDP drive waveforms shown in FIG. 4 are described in Japanese Patent Laid-open No. 241528/1993. Wc1, Wc2, and Wc3 are the pulse waveforms that are applied to scan electrodes Sc1, Sc2 and Sc3; Wu is the pulse waveform that is applied in common to sustain electrodes Su1, Su2, . . . , Sum; Wd is the pulse waveform that is applied to data electrodes D1, D2, . . . , Dn; and Id1 is the emission waveform.

As shown in FIG. 4, a sustain pulse of negative polarity is applied in common to each of sustain electrodes Su1, Su2, . . . , Sum in the mixed scan-sustain type of PDP drive method of the prior art.

Sustain pulses of negative polarity, in common with the pulses that are applied to sustain electrodes, are applied to each of scan electrodes Sc1, Sc2, . . . , Scm, and in addition, a sequential scan pulse (SP) and sustain erase pulse (EP) are also applied sequentially by scan electrode. Positive data pulses are applied to data electrodes D1, D2, . . . , Dn in accordance with display data.

To bring about light emission in the display cell at the intersection of scan electrode Sc1 and data electrode D1, for example, a positive data pulse is applied to data electrode D1 in synchronism with the scan pulse that is applied to scan electrode Sc1. A discharge is thus brought about in the display cell at the intersection of scan electrode Sc1 and data electrode D1, and light is emitted as shown by waveform Id1. This discharge emission is sustained by continuing to apply sustain pulses to each of scan electrode Sc1 and sustain electrode Su1, and halted by applying to scan electrode Sc1 a sustain erase pulse of low voltage and narrow width.

In contrast with other display devices, however, gray-scale display is difficult to achieve by varying the applied voltage in a PDP, and gray-scale display is therefore typically achieved by controlling the number of emissions of light. In particular, a sub-field method such as shown in FIG. 5 is used to realize high-luminance gray-scale display. FIG. 5 shows an example of displaying $2^6$=64 gray-scale levels.

In the sub-field method, as shown in FIG. 5, one frame is divided into a plurality (six in FIG. 5) of sub-fields (SF1-SF6) and a set-up discharge period, and a light emission time weight such as shown in FIG. 5 is conferred to each of these sub-fields. In FIG. 5, the light emission time weights of each sub-field progress in order from SF1 as: $2^5$, $2^4$, $2^3$, $2^2$, $2^1$, and $2^0$. Gray-scale display is realized by selecting emission or non-emission of light in each sub-field.

In the set-up discharge period, one discharge and erase (discharge halt) are first carried out in all display cells before writing display data to facilitate generation of write discharge by scan pulses and data pulses when all display cells are placed in an active state.

In the above-described PDP drive method, however, there is the problem of low utilization of time because other drive sequences must be suspended during the set-up discharge period. In particular, the time period that can be used for sub-fields is further limited in a case in which a plurality of set-up discharges are performed within one frame in order to allow stable generation of write discharge in sub-fields that are separated from the set-up discharge. As a result, the pulse width of the sustain pulses, scan pulses, and data pulses becomes shorter, and operation becomes unstable.

The above-described Japanese Patent Laid-open No. 241528/1993 discloses a method of minimizing the time lost in the set-up discharge periods in a case in which a plurality of set-up discharges are performed within one frame by making a sub-field that immediately precedes a set-up discharge period a sub-field with a smaller brightness weight, and moreover, altering the order of sub-fields (changing the order of weighting).

As another method of further decreasing the time lost in set-up discharge periods, Japanese Patent No. 2701725 discloses a method of performing set-up discharge on other scan lines while performing write discharge on any particular scan line.

In the method described in Japanese Patent No. 2701725, as shown in FIG. 6, pulse train that differ by scan line are applied not only to scan electrodes Sc1, Sc2, . . . , Scm but to sustain electrodes Su1, Su2, . . . , Sum as well; pulse voltages being applied to each display cell in the order: set-up discharge pulse, set-up discharge erase pulse, scan pulse, sustain pulse, and sustain erase pulse; and in addition, the timing of application of scan pulses being sequentially shifted by scan line and a corresponding data pulses being applied to each data electrode.

In the technique described in Japanese Patent No. 2701725, however, the set-up discharge pulse and scan pulse are both of negative polarity, the data pulse is of positive polarity, and all of these pulses are rectangular waves, and as a result, strong discharge occurs not only at display cells at the intersections of scan electrodes to which scan pulses are applied and data electrodes to which data pulses are applied, but also at display cells at the intersections of sustain electrodes to which set-up discharge pulses are applied and data electrodes to which data pulses are applied that are synchronized with these set-up discharge pulses. The problem therefore arises that the set-up discharge causes the entire background brightness of the PDP to increase, and the background brightness further varies with the pattern of the image display.

A method is described in U.S. Pat. No. 5,745,086 for preventing increase in background brightness by applying a gradually rising set-up discharge pulse and weakening the intensity of the set-up discharge. The drive method described in U.S. Pat. No. 5,745,086, however, is an invention relating to the separated scan-sustain type of PDP drive method in which the set-up discharge period, write discharge period, and sustain discharge period are each entirely separated from each other, and discloses nothing relating to the mixed scan-sustain type of PDP drive method, such as the method described in Japanese Patent No. 2701725.

SUMMARY OF THE INVENTION

It is an object of the present invention to provide a PDP drive method and drive circuit of the mixed scan-sustain type that reduces the time loss caused by set-up discharge period while suppressing increase in the background brightness caused by set-up discharge.

To achieve the above-described object according to the PDP drive method of the present invention, in a PDP drive method of the mixed scan-sustain type, when any particular scan line is in a write period, a set-up discharge is carried out in the scan line that is to be scanned next. At this time, a gradually rising first set-up discharge pulse that is of the opposite polarity of the scan pulses is applied to the scan electrodes of the scan line that is in a set-up discharge period, and a second set-up discharge pulse that is a rectangular or a gradually rising pulse of the same polarity as the scan pulse, and moreover, that is of lower voltage than the scan pulses, is applied to the sustain electrodes. The voltage of the second set-up discharge pulse in this case is a value such that discharge occurs with the first set-up discharge pulse, and such that discharge does not occur with a data pulse. In this way, the occurrence of discharge due to the set-up discharge pulse and a data pulse that is applied to data electrodes can be prevented, thereby preventing increase in the background brightness of the PDP.

Further, a set-up discharge erase pulse for eliminating set-up discharge and a sustain erase pulse for eliminating sustain discharge are applied with the same gradually falling pulse shape. The circuit for outputting the set-up discharge erase pulse and sustain erase pulse thus can be shared, thereby limiting increase in circuit scale.

Finally, one frame is divided into a plurality of sub-fields and all sub-fields within one frame are displayed by scan line, gray-scale display being realized by the combinations of the emission and non-emission of light of sub-fields. Since the need for providing a time interval at this time for set-up discharge is thus eliminated, the time of suspended emission of light between sub-fields can be reduced and the luminance of the plasma display panel can be increased.

In addition, one frame is divided into a plurality of sub-fields and the display of all scan lines by each sub-field takes the time of one frame, gray-scale display being realized by the combination of emission or non-emission of light of the sub-fields. The time of suspension of light emission between sub-fields is therefore further shortened, further increasing the luminance of the plasma display panel.

The above and other objects, features, and advantages of the present invention will become apparent from the following description based on the accompanying drawings which illustrate examples of preferred embodiments of the present invention.

DETAILED DESCRIPTION OF THE PREFERRED EMBODIMENTS

First Embodiment

Figure 7:
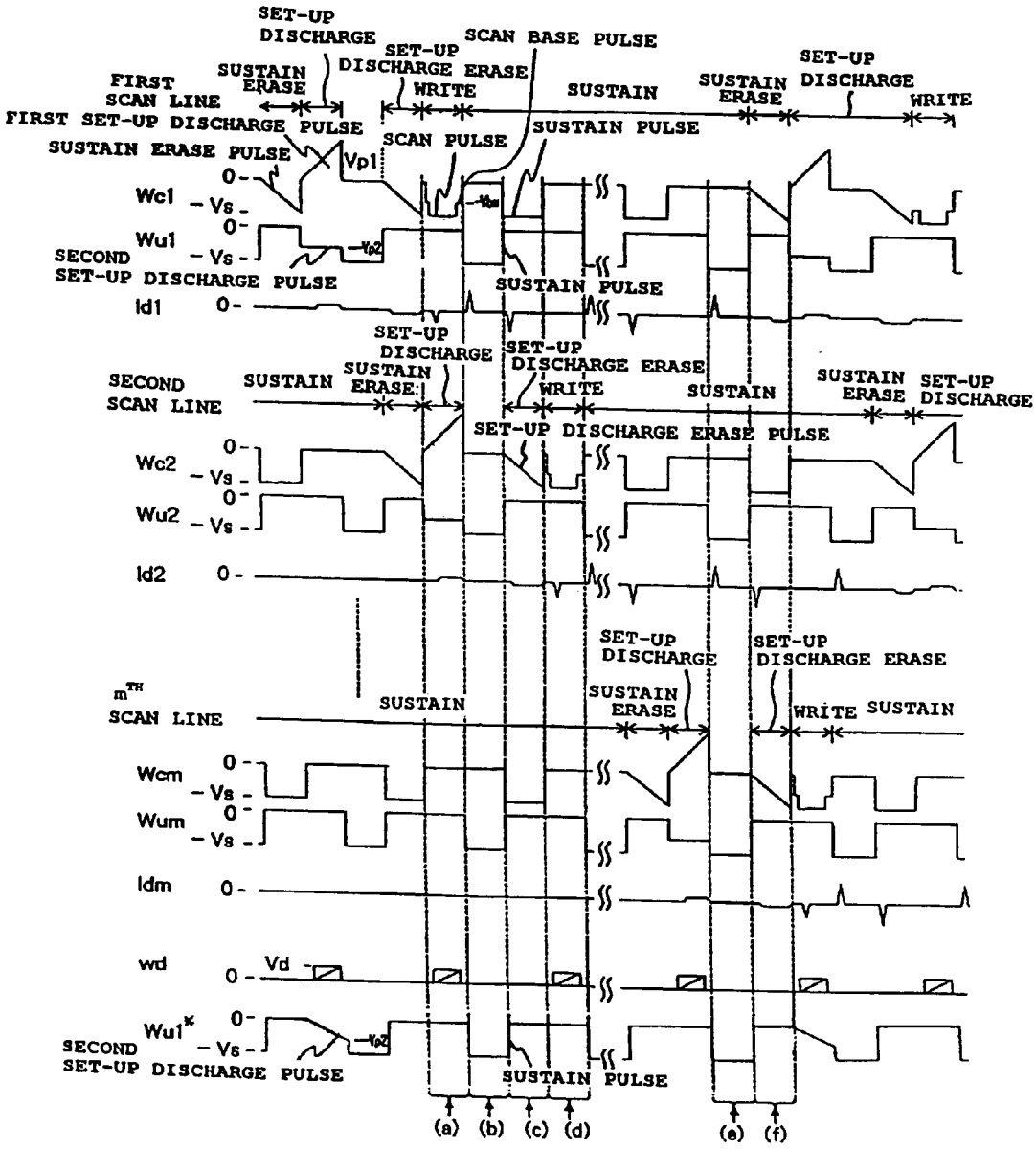
FIG. 7 is a waveform chart showing the operation of the first embodiment of the plasma display panel drive method of the present invention.

The first embodiment of the plasma display panel drive method of the invention is first explained using FIG. 7.

The PDP drive method of this embodiment is a mixed scan-sustain type of drive method, and the first period of the drive sequence is composed of: a set-up discharge period, a set-up discharge erase period, a write period, a sustain discharge period, and a sustain erase period; a desired image being obtained by repeating these periods for each scan line.

In FIG. 7, Wc1, Wc2, . . . , Wcm are pulse waveforms that are applied to scan electrodes Sc1, Sc2, . . . , Scm, respectively; and Wu1, Wu2, . . . , Wum are pulse waveforms that are applied to sustain electrodes Su1, Su2, . . . , Sum, respectively. Wd is the pulse waveform that is applied to data electrodes D1, D2, . . . , Dn; and Id1, Id2, . . . , Idn are the discharge current waveforms that flow in scan electrodes Sc1, Sc2, . . . , Scm. The configuration of the PDP is the same as that of an AC memory-type of the prior art, and explanation of this structure is therefore here omitted.

As shown in FIG. 7, when any particular scan line is in a write period (for example, the first scan line in FIG. 7) in the PDP drive method of this embodiment, a set-up discharge is carried out in the next scan line to be scanned (for example, the second scan line in FIG. 7). To prevent the occurrence of discharge due to the set-up discharge pulse and a data pulse that is applied to data electrodes at this time, as shown in FIG. 7, a gradually rising first set-up discharge pulse is applied to the scan electrodes of the scan line that is in the set-up discharge period, and a second set-up discharge pulse having a polarity that differs from the first set-up discharge pulse is applied to the sustain electrodes of the scan line that in the set-up discharge period.

Here, a gradually rising (having a slope lower than 5 V/μs) pulse of positive voltage is applied as the first set-up discharge pulse, and a pulse that satisfies the conditions of equations (1) and (2) below is applied as the second set-up discharge pulse.

$$Vp1+Vp2>>Vfsu \quad (1)$$

$$Vp2+Vd<Vfud \quad (2)$$

wherein Vp1 is the voltage of the first set-up discharge pulse, Vp2 is the voltage of the second set-up discharge pulse, Vfsu is the voltage between the scan electrodes and sustain electrodes at the start of discharge, Vd is the voltage of data pulses that are applied to the data electrodes, and Vfud is the voltage between the sustain electrodes and the data electrodes at the start of discharge. A rectangular pulse is applied as the second set-up discharge pulse in FIG. 7, but a waveform may also be used in which voltage changes gradually, as with the first set-up discharge pulse. For example, see signal line Wu1* in FIG. 7.

In this embodiment, when any particular scan line is in a set-up discharge period and set-up discharge erase period, scan lines other than the scan line in which the immediately preceding set-up discharge was performed are in the sustain discharge period (two emissions of light).

When any particular scan line is in a set-up discharge erase period, the sustain erase period of the next scan line that is to be scanned is caused to coincide with that set-up discharge erase period, and the set-up discharge erase pulse and sustain erase pulse are applied as the same gradually falling shape. The same drive circuit can thus be shared, thereby preventing an increase in circuit scale.

In this embodiment, moreover, when any particular scan line is in a write period, the scan pulse is applied on top of a scan base pulse (a pulse having a voltage of −Vbw). At this time, scan lines other than the scan line that is in the write period and the scan line that is in the set-up discharge period are in a rest period in which sustain discharge is not performed, but since the sustain electrodes in this embodiment are held at ground potential (0 V), i.,e., a higher potential than the scan electrodes, the annihilation of the wall charge that is generated by sustain discharge can be suppressed. Increase of the minimum sustain voltage necessary for sustain discharge can therefore be suppressed.

As in the prior art, data pulses are in synchronism with the application of scan pulses to scan electrodes and are applied to data electrodes corresponding to the display cells in which writing is to be performed. In addition, sustain discharge is continued by bringing about inversion of the potential of the scan electrodes and sustain electrodes from the ground potential to −Vs or from −Vs to the ground potential until a sustain erase pulse is applied.

The above-described scan base pulse is applied in order to lower the voltage of the scan pulse that is applied to the scan electrodes. Application of this scan base pulse enables a decrease of the maximum voltage used by the driver IC that generates scan pulses, and allows the use of a less expensive driver IC.

If the amplitude of the scan pulses is large, discharge will occur when the scan pulse is returning to higher voltage level due to the wall charge that is generated by the write discharge and the large number of active particles in the discharge space. This is an undesirable discharge that reduces the wall charges brought by the write discharge. The application of a scan base pulse, however, lowers the voltage of the scan pulses and prevents this undesirable discharge.

Figure 8:
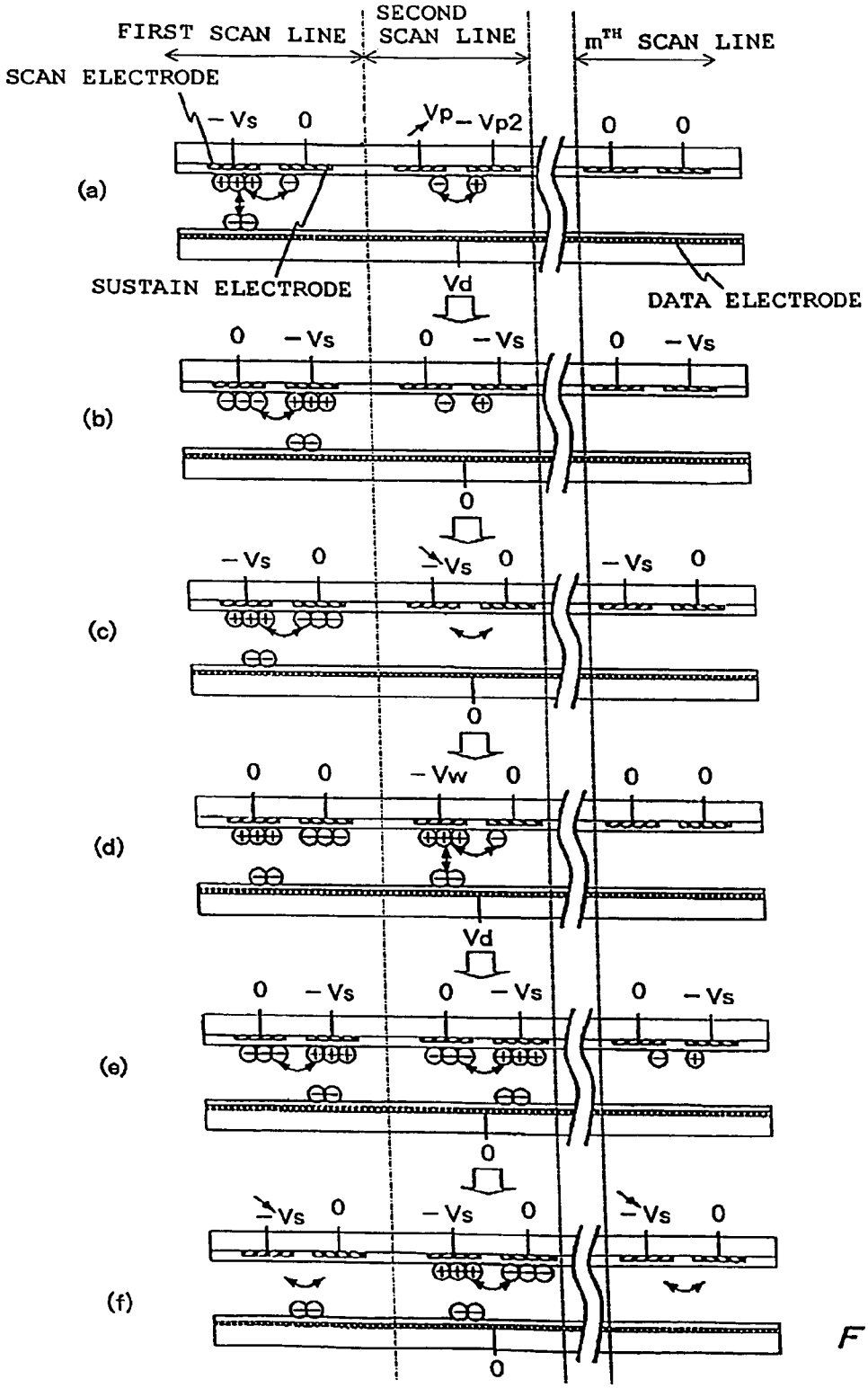
FIG. 8 is a schematic diagram showing how wall charge forms in a display cell in accordance with the pulse waveform shown in FIG. 7.

Explanation is next presented using FIG. 8 regarding the state of change in wall charge and the change in discharge inside display cells caused by the pulse waveforms shown in FIG. 7. The states of change in wall charge shown in (a)-(f) in FIG. 8 correspond to periods (a)-(f) shown in FIG. 7. The states of change of wall charge are explained below, taking as an example any display cells on the first scan line, second scan line, and $m^{th}$ scan line.

In FIG. 8(*a*), when a scan pulse is applied to scan electrode Sc1 on the first scan line and a data pulse is applied to any data electrode, discharge occurs between scan electrode Sc1 and the data electrode, and this discharge in turn also induces discharge between scan electrode Sc1 and sustain electrode Su1. At this time, positive wall charge accumulates at scan electrode Sc1, and a negative wall charge accumulates at the data electrode and sustain electrode Su1.

Meanwhile, on the second scan line, a first set-up discharge pulse is applied to scan electrode Sc2 and a second set-up discharge pulse is applied to sustain electrode Su2. At this time, a weak discharge occurs between scan electrode Sc2 and sustain electrode Su2, a relatively small negative wall charge accumulates at scan electrode Sc2, and a relatively small positive wall charge accumulates at sustain electrode Su2.

In FIG. 8(*b*), upon reversal of the voltage that is applied to scan electrode Sc1 and sustain electrode Su1 of the first scan line, a sustain discharge is generated between scan electrode Sc1 and sustain electrode Su1, a negative wall charge accumulates at scan electrode Sc1, and a positive wall charge accumulates at sustain electrode Su1.

On the second scan line, scan electrode Sc2 becomes the ground potential and −Vs is applied to sustain electrode Su2, but since there is no change in the relative electric potentials, the same state as FIG. 8(*a*) is maintained.

In FIG. 8(*c*), upon reversal of the voltage that is applied to scan electrode Sd1 and sustain electrode Su1 on the first scan line, sustain discharge occurs between scan electrode Sc1 and sustain electrode Su1, a positive wall charge accumulates at scan electrode Sc1, and a negative wall charge accumulates at sustain electrode Su1.

Meanwhile, on the second scan line, a set-up discharge erase pulse is applied to scan electrode Sc2, and the wall charge that had accumulated at scan electrode Sc2 and sustain electrode Su3 is annihilated.

In FIG. 8(*d*), the same state as in FIG. 8(*c*) is maintained when scan electrode Sc1 and sustain electrode Su1 on the first scan line both become the ground potential because the relative electric potential does not invert.

When a scan pulse is applied to scan electrode Sc2 on the second scan line and a data pulse is applied to a data electrode, however, discharge occurs between scan electrode Sc2 and the data electrode, and this discharge in turn induces a discharge between scan electrode Sc2 and sustain electrode Su2. At this time, a positive wall charge accumulates at scan electrode Sc2 and a negative wall charge accumulates at the data electrode and sustain electrode Su2.

When scan electrode Sc1 on the first scan line becomes the ground potential and −Vs is applied to sustain electrode Su1 in FIG. 8(*e*), the voltages applied to scan electrode Sc1 and sustain electrode Su1 inverts from the state of FIG. 8(*c*), whereby a sustain discharge occurs between scan electrode Sc1 and sustain electrode Su1, a negative wall charge accumulates at scan electrode Sc1, and a positive wall charge accumulates at sustain electrode Su1.

Further, when scan electrode Sc2 on the second scan line becomes the ground potential and −Vs is applied to sustain electrode Su2, a sustain discharge occurs between scan electrode Sc2 and sustain electrode Su2, whereupon a negative wall charge accumulates at scan electrode Sc2 and a positive wall charge accumulates at sustain electrode Su2.

On the $m^{th}$ scan line, a set-up discharge is performed immediately before and scan electrode Scm becomes the ground potential and −Vs is applied to sustain electrode Sum. Since the relative electric potential does not change from the time of the set-up discharge, however, a negative wall charge accumulates at scan electrode Scm and a positive wall charge accumulates at sustain electrode Sum.

In FIG. 8(*f*), the application of a sustain discharge erase pulse to scan electrode Sc1 on the first scan line brings about an erase discharge, which is a weak discharge state, and the wall charges that had accumulated at scan electrode Sc1 and sustain electrode Su1 are annihilated. However, the negative wall charge at the data electrode remains. Further, when −Vs is applied to scan electrode Sc2 on the second scan line and sustain electrode Su2 becomes the ground potential, sustain discharge occurs between scan electrode Sc2 and sustain electrode Su2, whereby a positive wall charge accumulates at scan electrode Sc2 and a negative wall charge accumulates at sustain electrode Su2.

A set-up discharge erase pulse is further applied to scan electrode Scm on the $m^{th}$ scan line, and the wall charges that had accumulated at scan electrode Scm and sustain electrode Sum are annihilated.

Figure 1:
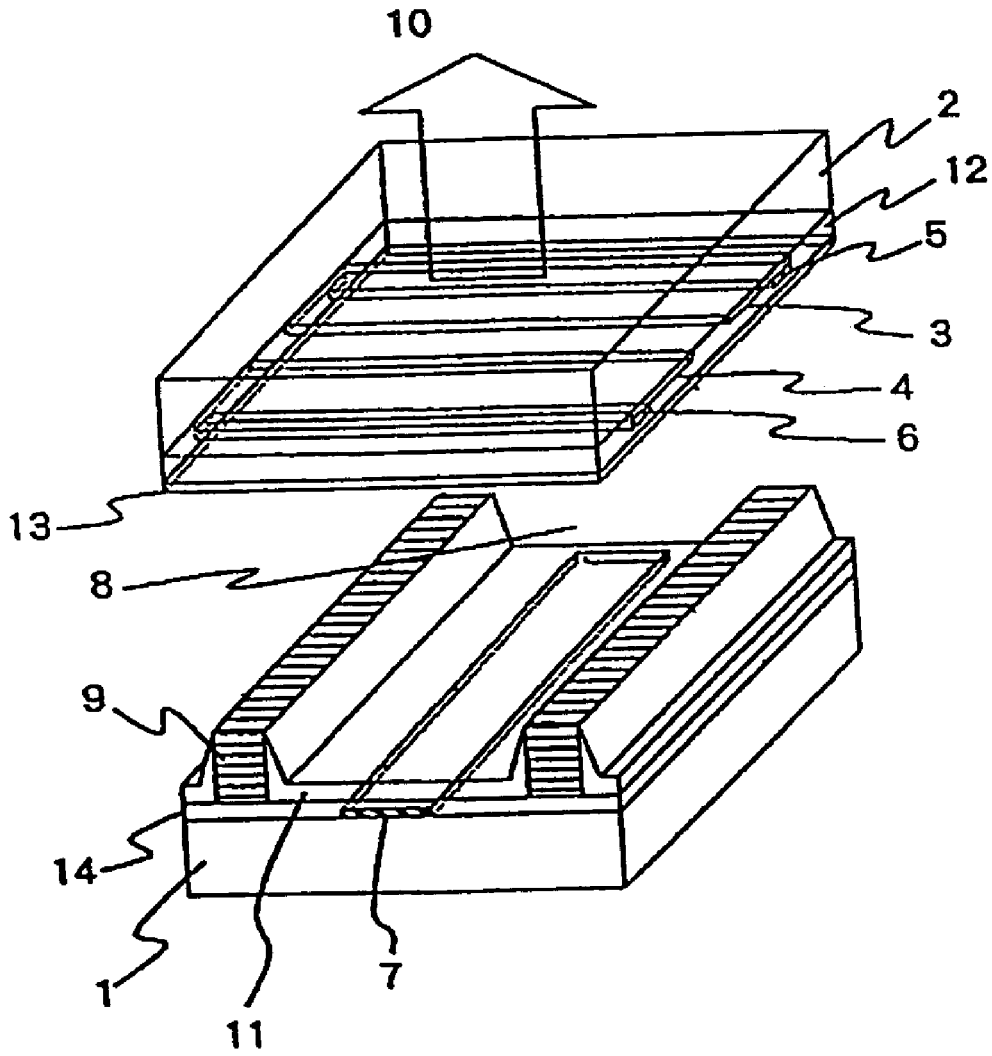
FIG. 1 (PRIOR ART)
FIG. 1 is a perspective sectional view of a display cell showing one example of the construction of an AC plasma display panel.
Figure 2:
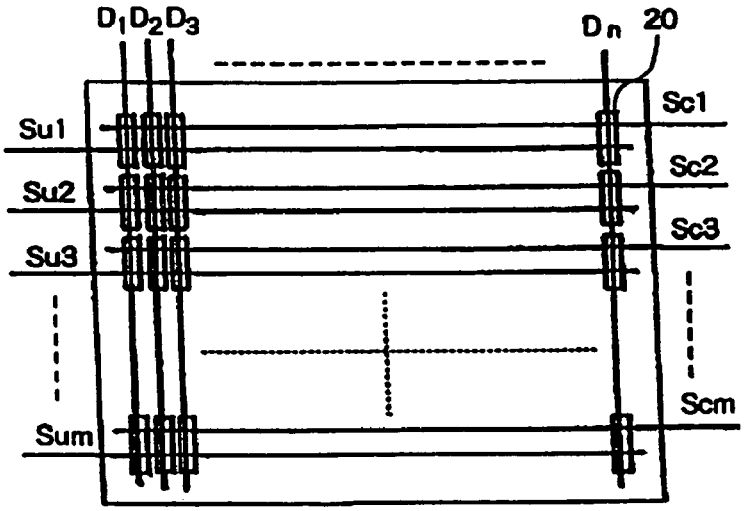
FIG. 2 (PRIOR ART)
FIG. 2 is a schematic plan view showing the structure of a plasma display panel in which the display cells shown in FIG. 1 are arranged in a matrix.
Figure 3:
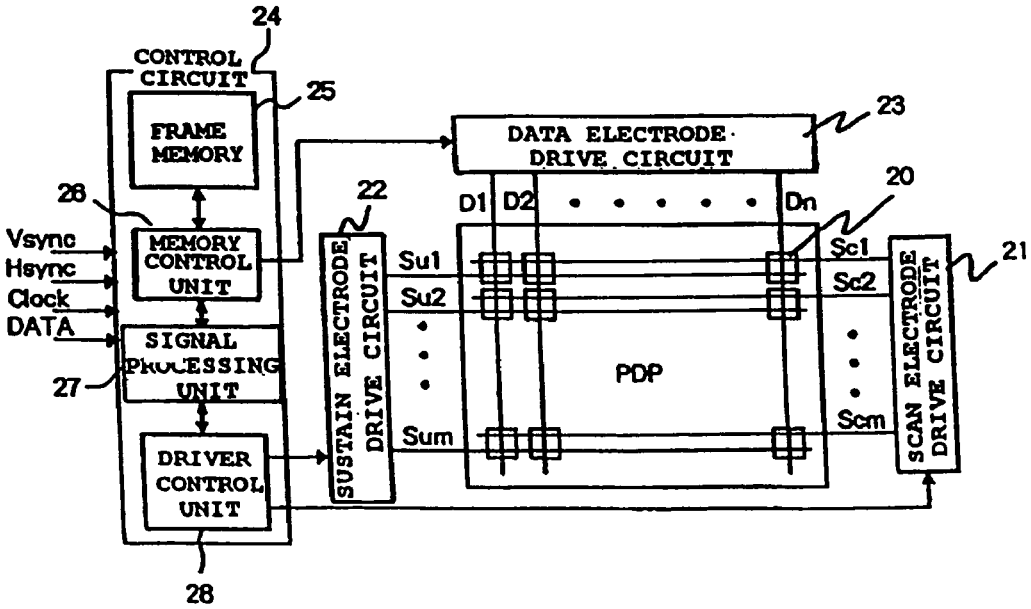
FIG. 3 (PRIOR ART)
FIG. 3 is a block diagram showing the configuration of a drive circuit for driving the plasma display panel shown in FIG. 2.
Figure 4:
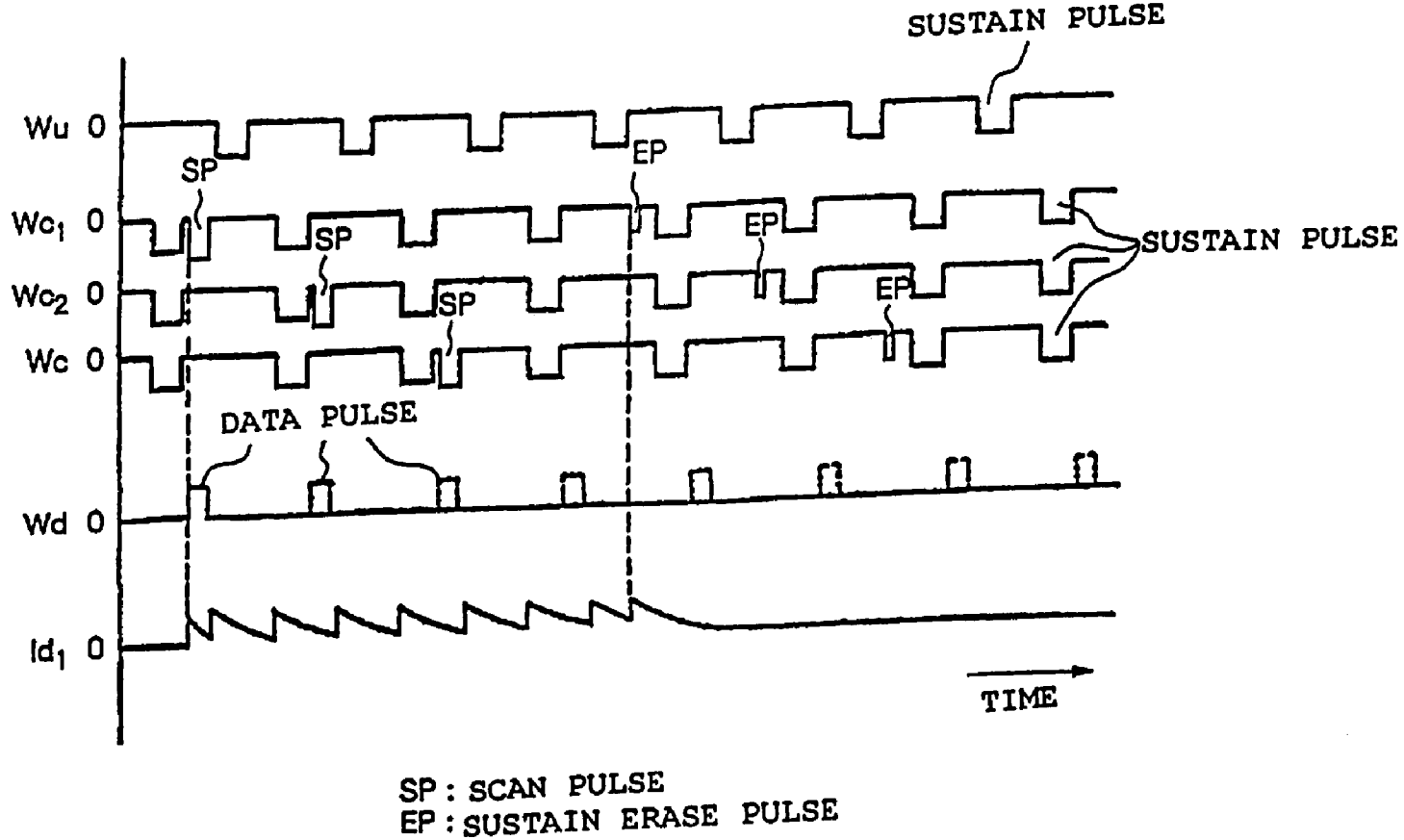
FIG. 4 (PRIOR ART)
FIG. 4 is a waveform chart showing one example of the drive method of a plasma display panel of the prior art.
Figure 5:
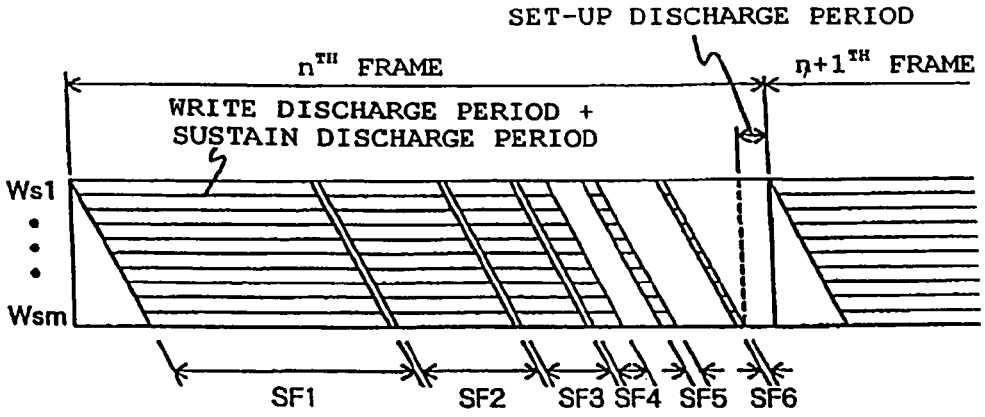
FIG. 5 (PRIOR ART)
FIG. 5 is a timing chart showing one example of the sub-field method for realizing gray-scale display.
Figure 6:
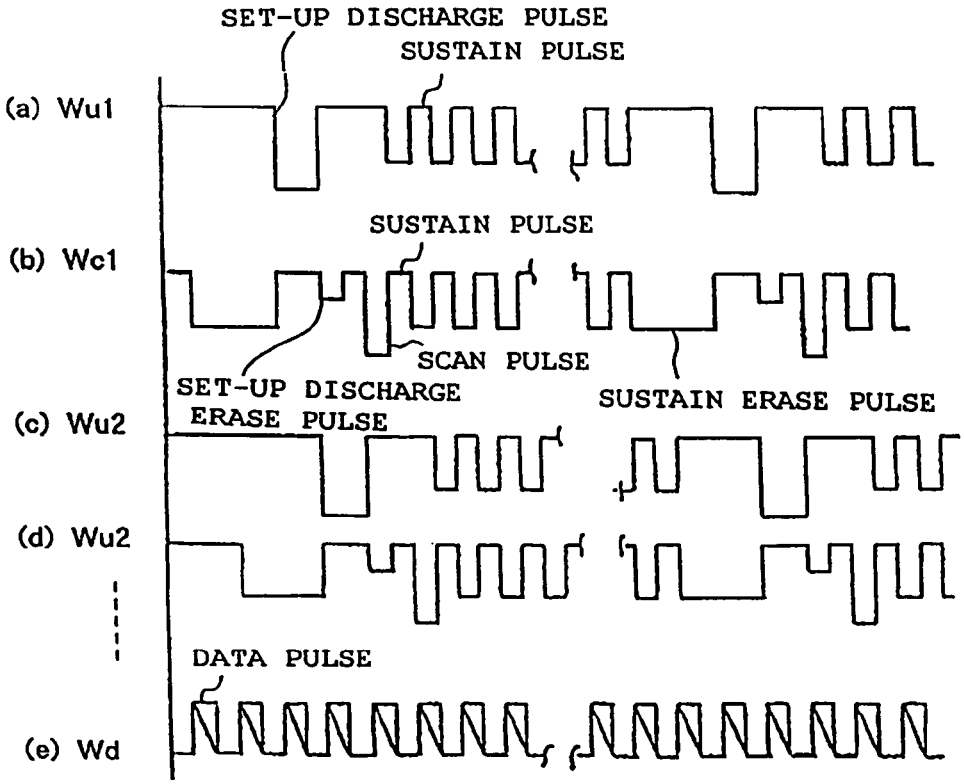
FIG. 6 (PRIOR ART)
FIG. 6 is a waveform chart showing another example of a drive method for a plasma display panel of the prior art.
Figure 9:
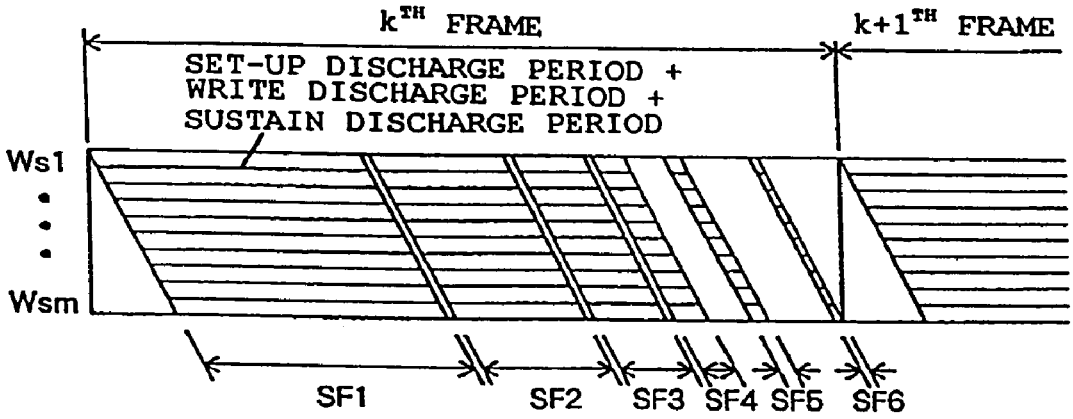
FIG. 9 is a timing chart for explaining the sub-field method used in the first embodiment of the plasma display panel drive method of the present invention.

Combining the PDP drive method of this embodiment with the sub-field method described in the prior art makes possible PDP gray-scale display. In such a case, there is no need for periods provided exclusively for set-up discharge (refer to FIG. 5), as shown in FIG. 9, and the time of suspended emission of light in one frame period can be shortened.

Therefore, the rate of sustain discharge can be raised and the luminance of the PDP can be increased. Further, a different weight is assigned to the light emission time of each sub-field in FIG. 9, but it is also possible to assign the same weight to a plurality of sub-fields.

Figure 10:
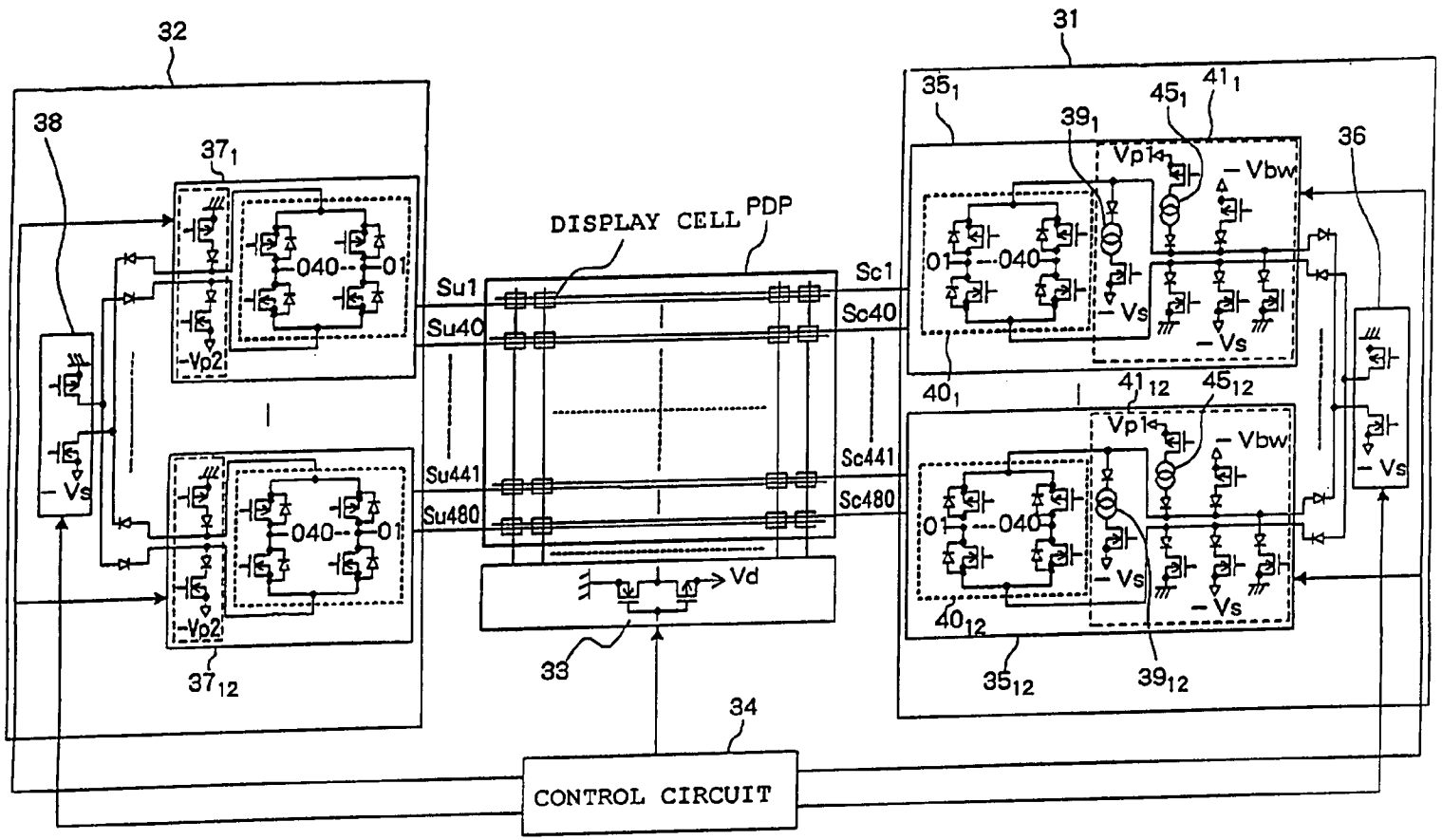
FIG. 10 is a block diagram showing the configuration of the first embodiment of the plasma display panel drive circuit of the present invention.

Referring now to FIG. 10, the operation of the first embodiment of the PDP drive circuit of this invention is next explained. FIG. 10 shows an example of a PDP having 480 scan lines.

As in the prior art, the PDP drive circuit of this embodiment in FIG. 10 is made up of: scan electrode drive circuit 31 for applying a pulse voltage to each of scan electrodes Sc1, Sc2, . . . , Sc480; sustain electrode drive circuit 32 for applying a pulse voltage to each of sustain electrodes Su1, Su2, . . . , Su480; data electrode drive circuit 33 for applying a voltage according to image signals to each data electrode; and control circuit 34 for outputting control signals to each electrode drive circuit based on vertical synchronizing signals, horizontal synchronizing signals, display data signals, and clock signals.

Scan electrode drive circuit 31 includes, for example, twelve scan electrode drivers $\mathbf{35}_1$-$\mathbf{35}_{12}$ of 40-bit output that are connected in parallel as drivers for selectively applying scan pulses by scan line, and scan electrode common driver 36 to which each of the scan electrode drivers is connected in common.

Sustain electrode drive circuit 32 similarly includes: for example, twelve sustain electrode drivers $\mathbf{37}_1$-$\mathbf{37}_{12}$ of 40-bit output that are connected in parallel as drivers for selectively applying sustain pulses by scan line, and sustain electrode common driver 38 to which each of the sustain electrode drivers is connected in common.

Scan electrode drivers $\mathbf{35}_1$-$\mathbf{35}_{12}$ and sustain electrode drivers $\mathbf{37}_1$-$\mathbf{37}_{12}$ each include drive units $\mathbf{40}_1$-$\mathbf{40}_{12}$ for driving each scan electrode or sustain electrode, and switches $\mathbf{41}_1$-$\mathbf{41}_{12}$ for supplying various power supply voltages to drive units $\mathbf{40}_1$-$\mathbf{40}_{12}$ and outputting the pulse waveforms shown in FIG. 7. Drive units $\mathbf{40}_1$-$\mathbf{40}_{12}$ are made up of 40 sets of driver FETs including p-channel FETs and n-channel FETs that are push-pull connected; and switches $\mathbf{41}_1$-$\mathbf{41}_{12}$ are made up of a plurality of switch FETs that are connected to various voltage supplies (a first set-up discharge pulse voltage of Vp1, a second set-up discharge pulse voltage of −Vp2; a scan base pulse voltage of −Vb2; a sustain pulse voltage of −Vs; and the ground potential). The switch FETs are each ON/OFF controlled by control circuit 34 such that the pulse waveforms of the drive sequence shown in FIG. 7 are output from the driver FETS.

Constant-current elements $\mathbf{39}_1$-$\mathbf{39}_{12}$ are circuits for outputting a gradually rising set-up discharge erase pulse and sustain erase pulse; and constant-current element $\mathbf{45}_1$-$\mathbf{45}_{12}$ are circuits for outputting a gradually rising set-up discharge pulse. In addition, scan electrode common driver 36 and sustain electrode common driver 38 are circuits for supplying −Vs to the source of each p-channel FET of drive units $40_1$-$40_{12}$, and for making the source of each n-channel FET the ground potential.

Second Embodiment

The second embodiment of the invention is next explained with reference to the accompanying figures.

Figure 11:
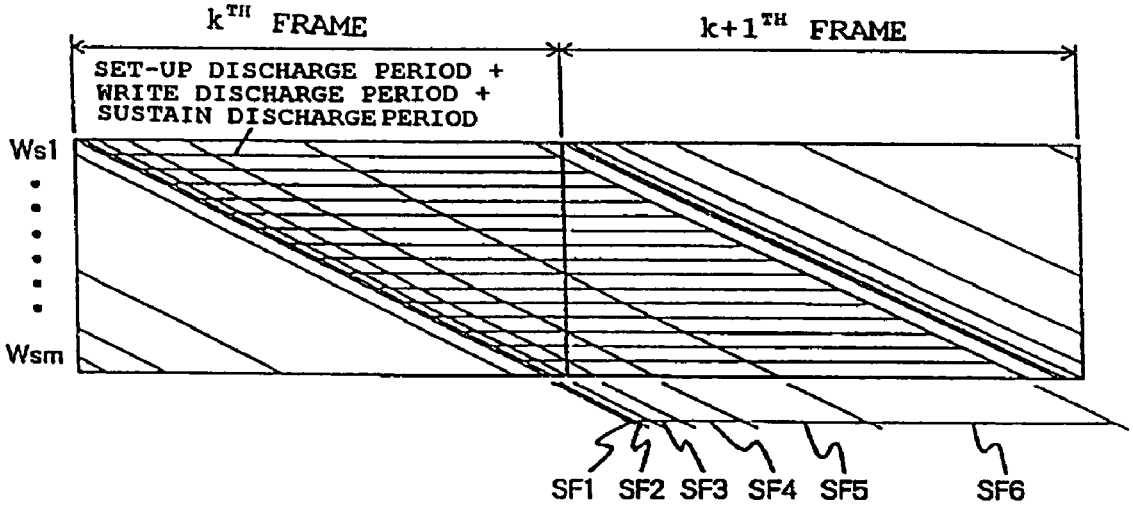
FIG. 11 is a timing chart for explaining the sub-field method used in the second embodiment of the plasma display panel drive method of the present invention.

Methods for achieving gray-scale display in an AC memory-type PDP include dividing one frame into a plurality of sub-fields that are each given a time weight, and then, either displaying all sub-fields by scan line within a frame as shown in FIG. 9, or taking the time of one frame to display all scan lines for each sub-field, as shown in FIG. 11.

In the drive method shown in FIG. 11, the time interval in which the emission of light is suspended between each sub-field can be made even shorter than in the drive method shown in FIG. 9, and the number of sustain emissions can therefore be increased, thereby also increasing the luminance of the PDP.

In a sub-field method such as shown in FIG. 11, rather than carrying out write discharge in sequence per line, the time interval of the write period is divided by the number of sub-fields, and the write timing that corresponds to each sub-field is then reserved so that each sub-field is processed.

Figure 12:
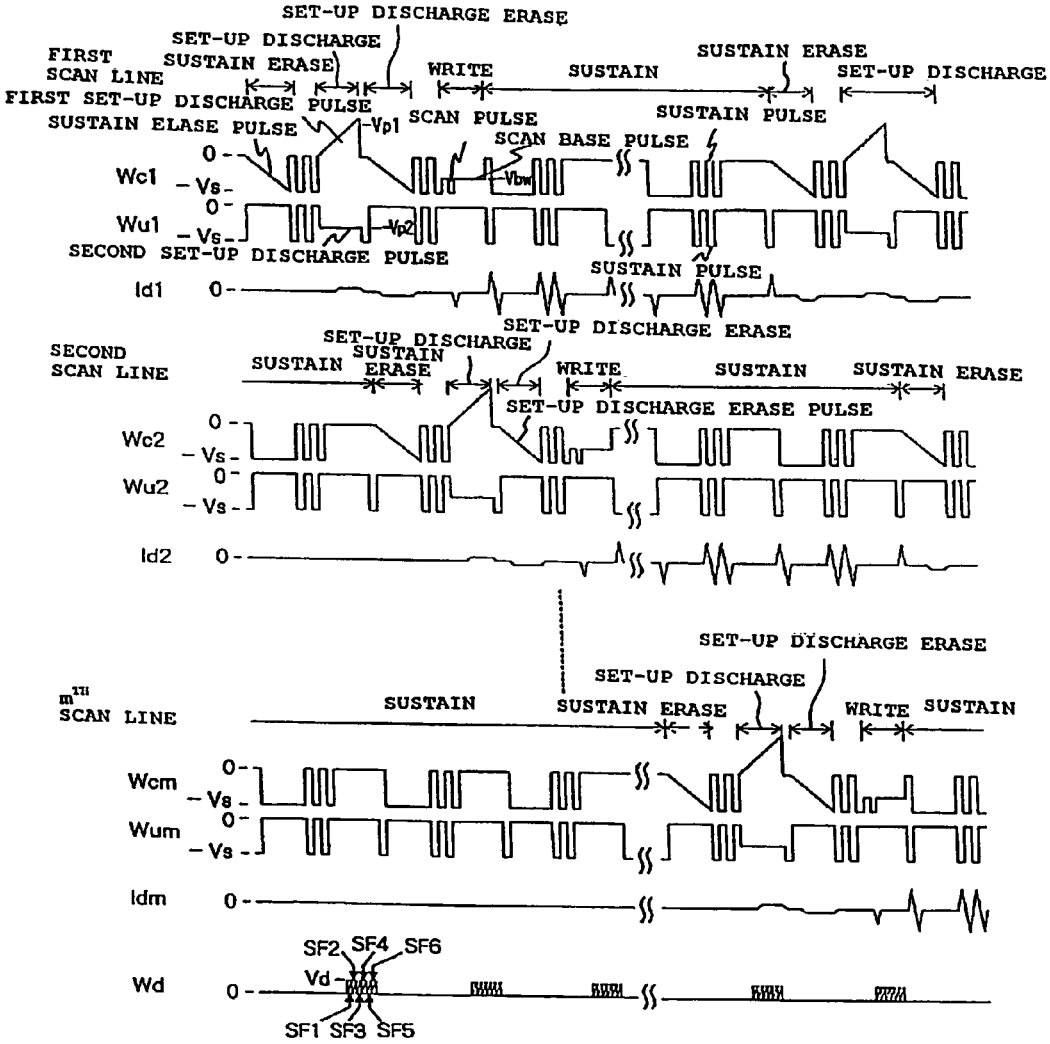
FIG. 12 is a waveform chart showing the states of operation of the second embodiment of the plasma display panel drive method of the present invention.

As shown in FIG. 12, the write period in this embodiment is divided into six portions, and write timings for sub-fields 1 (SF1), 2 (SF2), 3 (SF3), 4 (SF4), 5 (SF5), 6 (SF6) are then assigned starting from the beginning of the divided write period.

The number of sustain light emissions are increased by inserting narrow sustain pulses only during the periods of sustain discharge, thereby enabling a further increase in the luminance of the PDP.

In this embodiment, moreover, the set-up discharge erase pulse and sustain erase pulse are made wider than in the first embodiment. For example, if the width of one scan pulse is made the same as in the first embodiment, the width of the set-up discharge pulse in this embodiment is six times that of the first embodiment. Since the rise of the set-up discharge pulse can therefore be made more gradual, the set-up discharge can be made even weaker with stability, thereby making the wall charge more amenable to control and enabling stable suppression of luminance caused by set-up discharge so as to afford an improvement in the contrast of the PDP display.

In addition, the set-up discharge erase pulse and sustain erase pulse in this embodiment are made the same shape, as in the first embodiment, this being a gradually rising pulse. As for the PDP drive circuit in this embodiment, the ON/OFF timing of each switch FET under the control of the control circuit differs from the first embodiment, but the circuit configuration is the same as in the first embodiment, and explanation is therefore here omitted.

Third Embodiment

The third embodiment of the present invention is next explained with reference to the accompanying figures.

Regarding the voltages applied to the scan electrodes and sustain electrodes, the relation between the electric potentials of the two types of electrodes may be the same as in the first embodiment or the second embodiment, and for example, a set-up discharge erase pulse or sustain erase pulse need not be applied to scan electrodes.

Figure 13:
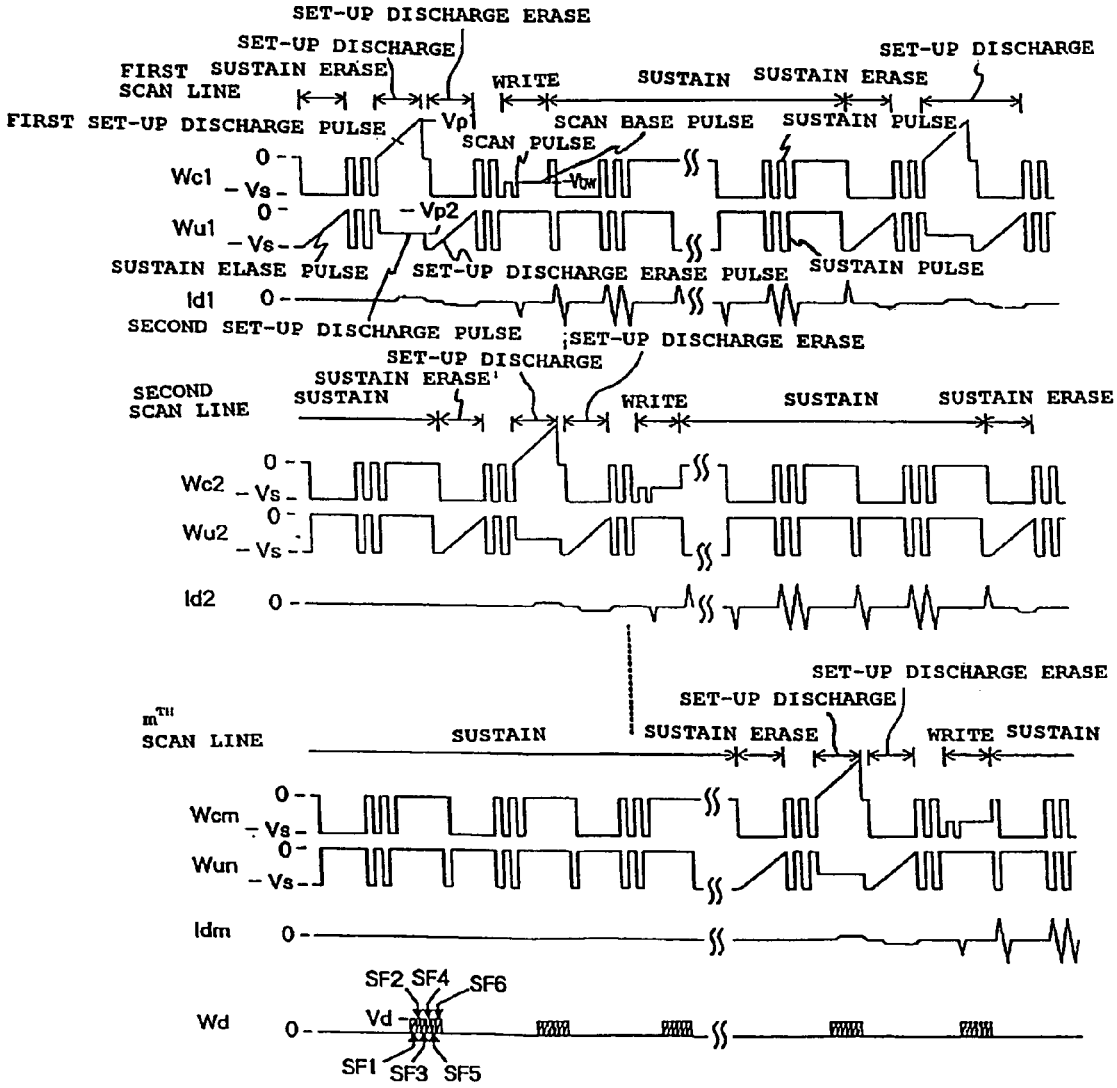
FIG. 13 is a waveform chart showing the states of operation of the third embodiment of the plasma display panel drive method of the present invention.

As shown in FIG. 13, the PDP drive method of this embodiment is a method in which a set-up discharge erase pulse and sustain erase pulse are applied to each sustain electrode.

The pulse waveforms shown in FIG. 13 are for an example in which the drive method of this embodiment is applied to the pulse waveforms of the second embodiment shown in FIG. 12, the drive sequence being the same as in the second embodiment. In the drive sequence of the first embodiment shown in FIG. 7, as well, the set-up discharge erase pulse and sustain erase pulse may each be applied to sustain electrodes as in this embodiment. Further, the set-up discharge erase pulse and sustain erase pulse may be a gradually rising pulse with the same shape, as in the first embodiment.

The same effect as in the first embodiment or second embodiment can also be obtained in the PDP drive method of this embodiment, in which a set-up discharge erase pulse and a sustain erase pulse are each applied to sustain electrodes as shown in FIG. 13.

Figure 14:
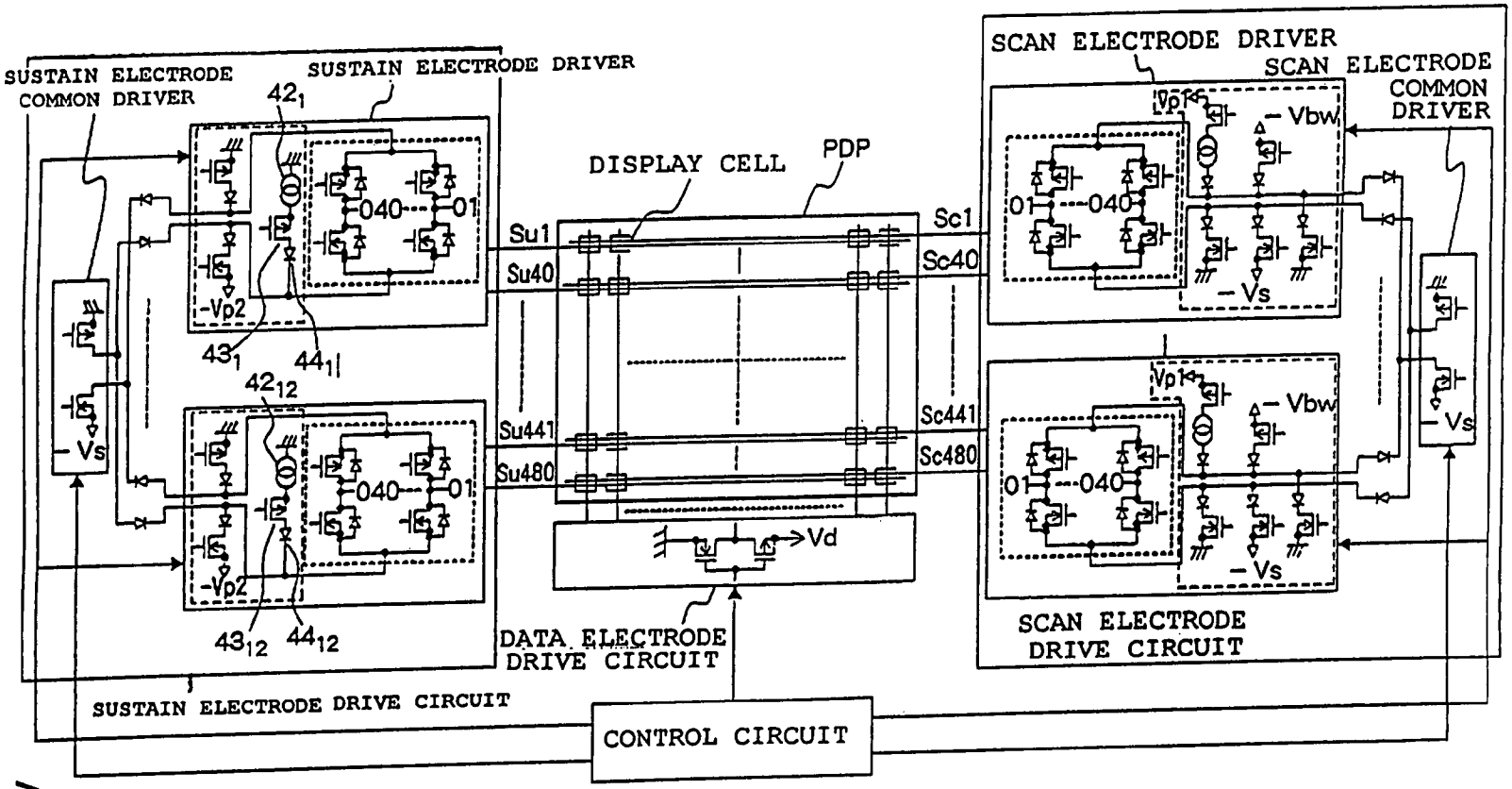
FIG. 14 is a block diagram showing the configuration of the third embodiment of the plasma display panel drive circuit of the present invention.

As shown in FIG. 14, the PDP drive circuit of this embodiment has a configuration in which the circuitry for applying set-up discharge erase pulses and sustain erase pulses, which is incorporated in the scan electrode driver in the first embodiment, is moved to the sustain electrode driver. In other words, the PDP drive circuit of this embodiment is of a configuration in which constant-current circuits $42_1$-$42_{12}$ for applying set-up discharge erase pulses and sustain erase pulses, switch FETs $43_1$-$43_{12}$ for ON/OFF control of these constant-current circuits $42_1$-$42_{12}$, and diodes $44_1$-$44_{12}$ are each added to the switch unit of the sustain electrode driver. The configuration is otherwise the same as that of the first embodiment, and explanation is therefore here omitted. FIG. 14 shows an example of a PDP having 480 scan lines.

Fourth Embodiment

The fourth embodiment of the present invention is next explained with reference to the accompanying figures.

In this embodiment, a charge- (power-) recovering circuit for reducing power consumption is added to the PDP drive circuit shown in FIG. 10 or. FIG. 14.

The charge recovery circuit is a circuit for recovering and reusing the charge that is stored in each display cell of the PDP, generally known charge recovery circuits being a charge-storing charge recovery circuit that recovers the charge of each display cell by means of an outside charge-storing capacitor, and a self-recovering charge recovery circuit that recovers charge by means of the capacitance inherent to each display cell of the PDP.

First, a simple explanation is presented regarding the principles of operation of the charge recovery circuits.

(1) Charge-storing Charge Recovery Circuit

Figure 15A:
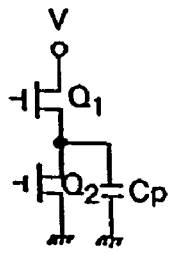
FIG. 15A is a circuit diagram showing the configuration of the push-pull connected driver circuit for explaining the principles of operation of the charge-storing type of charge recovery circuit incorporated in the plasma display panel drive circuit of the present invention.
Figure 15B:
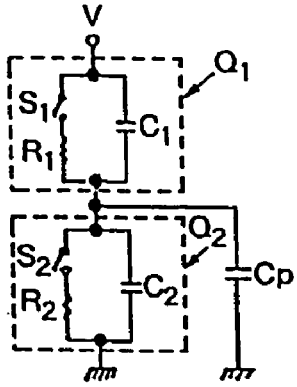
FIG. 15B is an equivalent circuit diagram of the driver circuit shown in FIG. 15A.

As an example, in a case in which a structure such as shown in FIG. 15A is used as a driver circuit for driving each electrode of a PDP, the circuit shown in FIG. 15A can be represented by the equivalent circuit of FIG. 15B. FIG. 15B shows transistors Q1 and Q2 shown in FIG. 15A as ON resistors R1 and R2, switches S1 and S2, and output capacitors C1 and C2. In this type of driver circuit, the energy $(C1+C2+Cp)\,V^2$ is consumed each time a pulse of voltage V is applied to load capacitance Cp. This energy is consumed by the ON resistors R1 and R2 of the elements, or by the internal resistance of the power supply unit that supplies voltage V.

Figure 16:
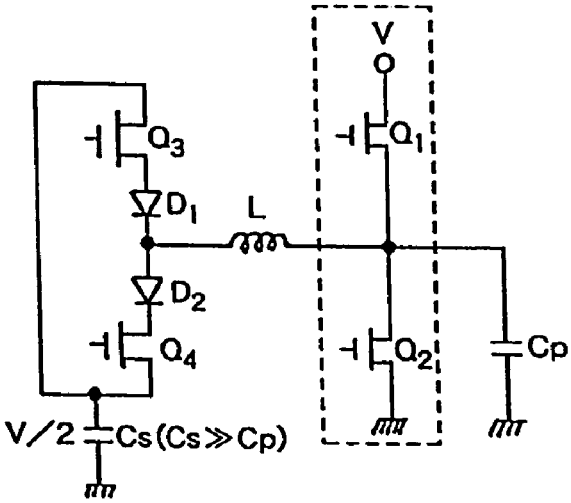
FIG. 16 is a circuit diagram showing the configuration of the charge-storing type of charge recovery circuit incorporated in the plasma display panel drive circuit of the present invention.
Figure 17:
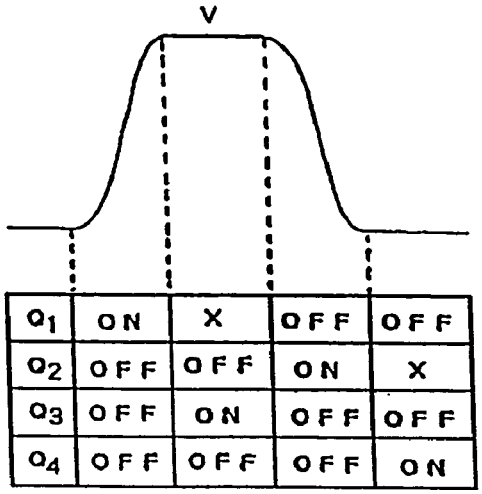
FIG. 17 shows the voltage waveforms of the load capacitance corresponding to the ON/OFF timing of the switch elements shown in FIG. 16.

As shown in FIG. 16 and FIG. 17, a charge-storing charge recovery circuit recovers power by using LC resonance to supply charge from an outside charge-storing capacitor Cs (Cs>>Cp) when the voltage applied to the load capacitance Cp is raised, and to return charge to charge-storing capacitor Cs from load capacitance Cp when the voltage is lowered.

(2) Self-recovering Charge Recovery Circuit

Figure 18:
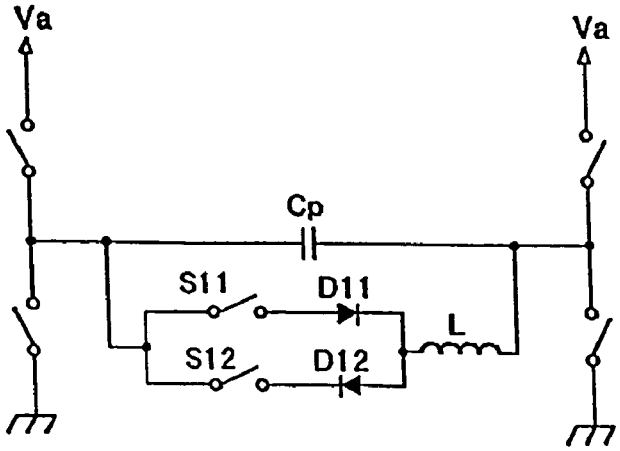
FIG. 18 is a circuit diagram showing the configuration of the self-recovering type of charge recovery circuit incorporated in the plasma display panel drive circuit of the present invention.

As shown in FIG. 18, a self-recovering charge recovery circuit is a structure in which inductor L, which is connected in a series with switches S11 and S12 and diodes D11 and D12, is connected in parallel to load capacitance Cp, and as with the charge-storing type, is a method that uses LC resonance during charge recovery.

Figure 19:
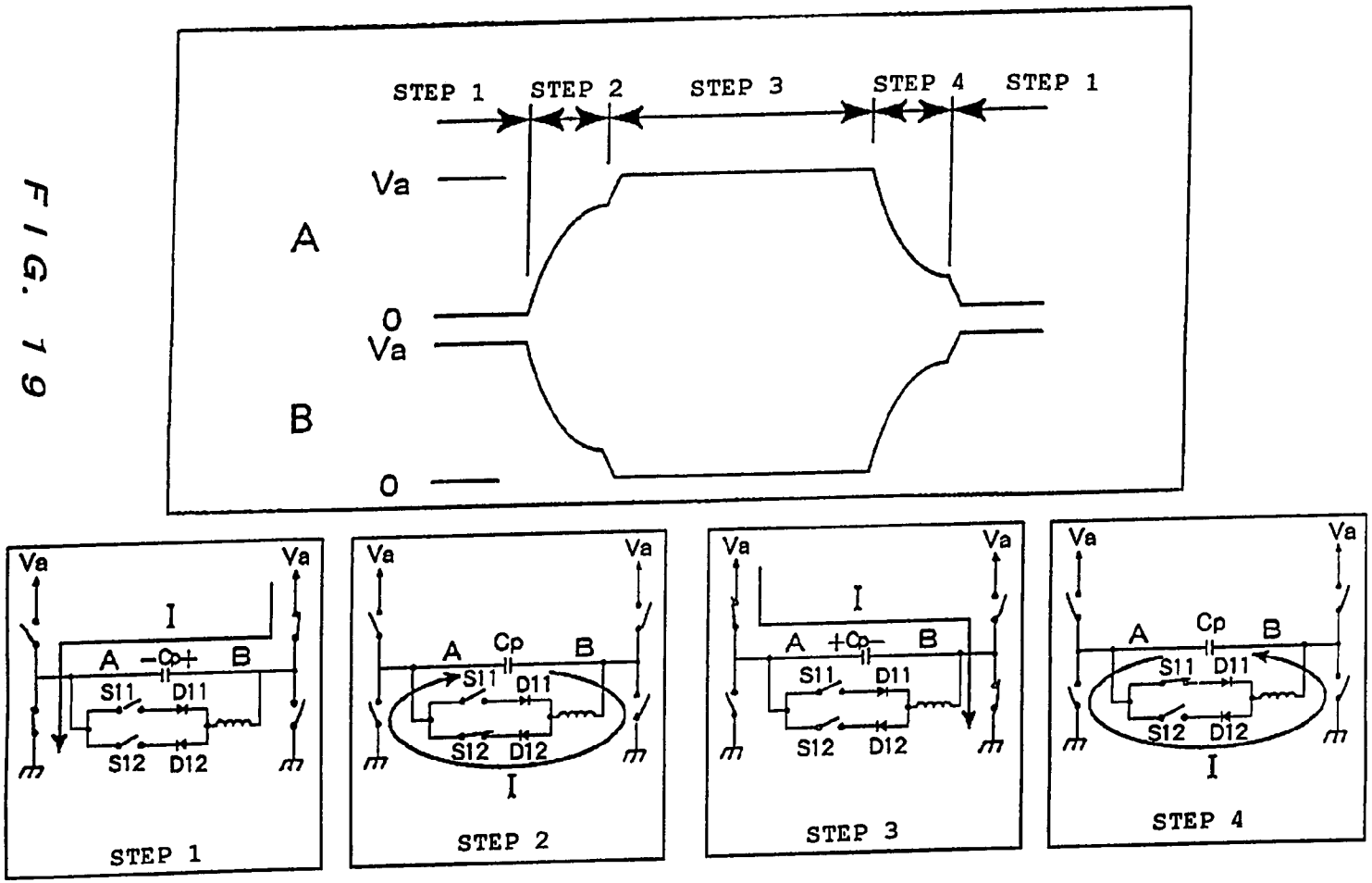
FIG. 19 is a sequence chart showing the states of operation of the self-recovering type of charge recovery circuit shown in FIG. 18.

As shown in FIG. 19, current I is supplied from the driver circuit to load capacitance Cp in the direction from point B to point A in Step 1, and when the supply of power from the driver circuit stops in Step 2, the charge stored in load capacitance Cp is recovered by load capacitance Cp itself by way of switch S12, diode D12, and inductor L.

Next, in Step 3, current I is supplied from the driver circuit to load capacitance Cp in the direction from point A to point B, and when the supply of power from the driver circuit stops in Step 4, the charge stored in load capacitance Cp is recovered in the load capacitance Cp itself by way of switch S11, diode D11, and inductor L.

Figure 20:
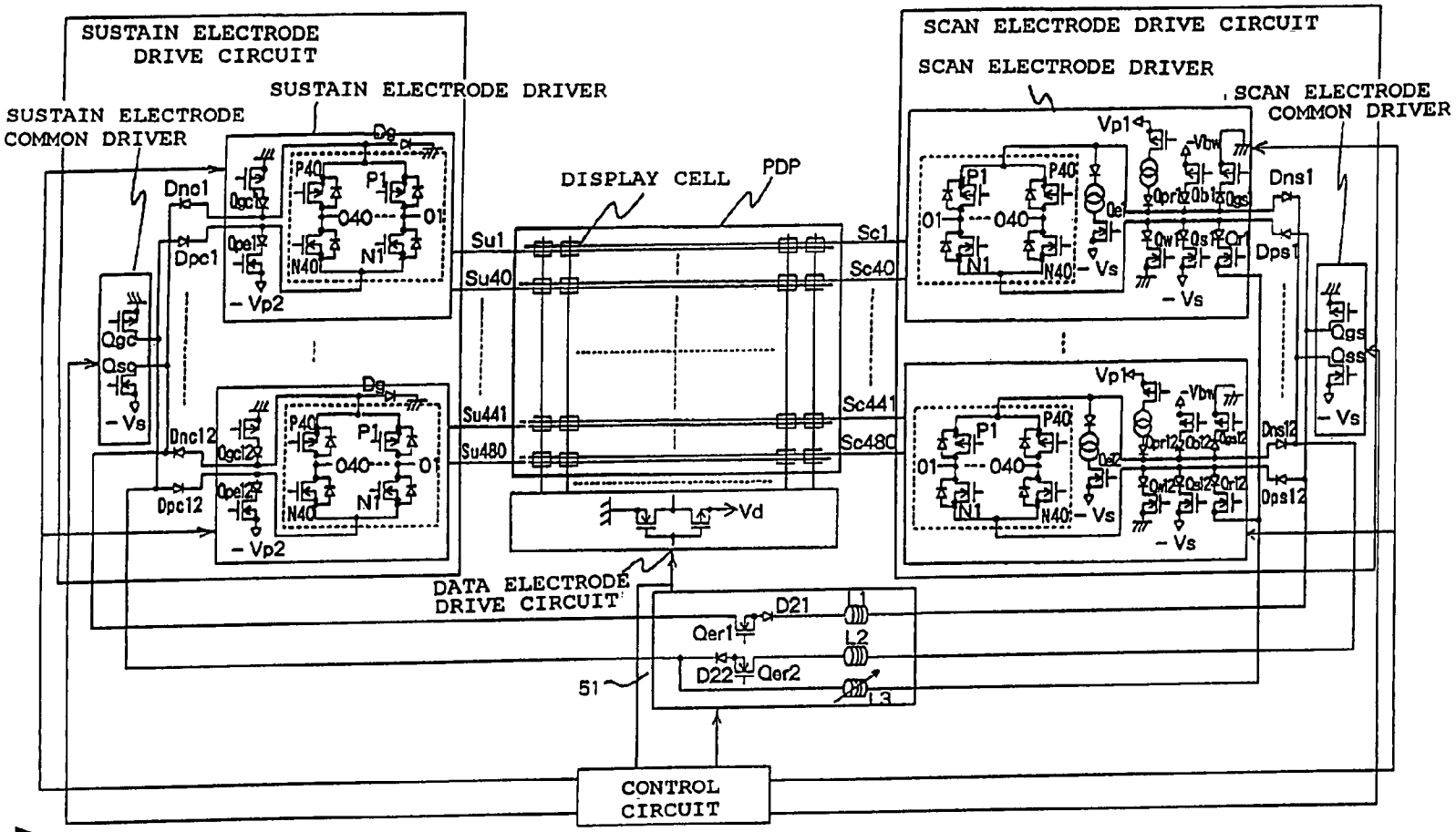
FIG. 20 is a circuit diagram showing the configuration of the fourth embodiment of the plasma display panel drive circuit of the present invention, including the self-recovering type of charge recovery circuit.
Figure 21:
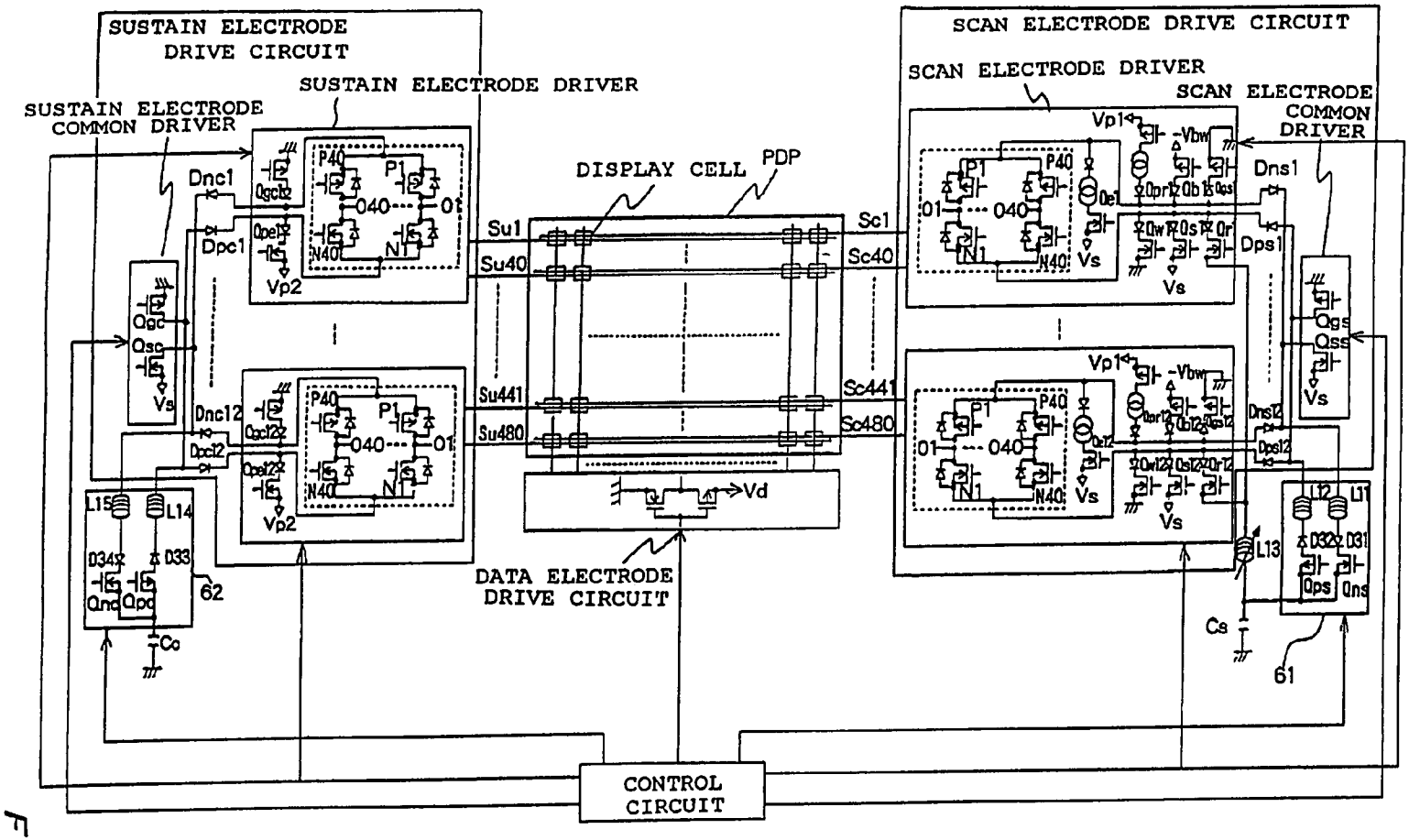
FIG. 21 is a circuit diagram showing the configuration of the fourth embodiment of the plasma display panel drive circuit of the present invention, including a charge-storing type of charge recovery circuit.

Referring to FIG. 20 and FIG. 21, explanation is next presented regarding a configuration in which the above-described charge recovery circuit is incorporated into the PDP drive circuits of this invention.

The PDP drive circuit shown in FIG. 20 is a configuration in which the self-recovering type of charge recovery circuit is added to the drive circuit of the first embodiment shown in FIG. 10.

As shown in FIG. 20, a PDP drive circuit of this embodiment provided with the self-recovering charge recovery circuit is a configuration in which charge recovery circuit 51 is connected between the power supply line for supplying power to scan electrodes and the power supply line for supplying power to sustain electrodes.

Charge recovery circuit 51 is made up of: diode D21 and n-channel FET Qer1 connected in a series to inductor L1; diode D22 and n-channel FET Qer2 connected in a series to inductor L2; and inductor L3 having a variable inductance value. One end of inductor L3 is connected to the cathode of diode D22, and the other end of inductor L3 is connected to each of the sources of n-channel FETs Qr1-Qr12 that belong to each switch unit of the scan electrode driver.

Further, as shown in FIG. 20, the p-channel FETs of the drive unit of each scan electrode driver and sustain electrode driver are P1-P40, respectively, and the n-channel FETs are N1-N40, respectively. In addition, Qe1-Qe12 are switch FETs that are connected in a series to constant-current elements of the scan electrode drivers; Qpr1-Qpr12 are switch FETs that are connected in a series to power supply Vp1 for the first set-up discharge pulse; Qb1-Qb12 are switch FETs that are connected in a series to power supply −Vbw for the scan base pulse; Qgs1-Qgs2 are switch FETs for making the sources of p-channel FETs P1-P40 of each scan electrode driver the ground potential; Qw1-Qw12 are switch FETs for making the sources of n-channel FETs N1-N40 of each scan electrode driver the ground potential; and Qs1-Qs12 are switch FETs that are connected in a series to power supply voltage −Vs for sustain pulses.

Diodes Dns1-Dns12 are for connecting the sources of p-channel FETs P1-P40 of the scan electrode drivers to the scan electrode common driver, and diodes Dps1-Dps12 are for connecting the sources of the n-channel FETs N1-N40 to the scan electrode common driver.

Finally, Qgs is the p-channel FET of the scan electrode common driver for making the sources of n-channel FETs N1-N40 of the scan electrode drivers the ground potential; and Qss is the n-channel FET of the scan electrode common driver for making the sources of p-channel FETs P1-P40 of the scan electrode drivers −Vs.

Similarly, switch FETs Qpe1-Qpe12 are connected in a series to power supply −Vp2 for the second set-up discharge pulse of the sustain electrode drivers; and switch FETs Qgc1-Qgc12 are for making the sources of p-channel FETS P1-P40 of the sustain electrode drivers the ground potential.

Diodes Dnc1-Dnc12 are for connecting the sources of p-channel FETs P1-P40 of the sustain electrode drivers to the sustain electrode common driver; and diodes Dpc1-Dpc12 are for connecting the sources of n-channel FETs N1-N40 to the sustain electrode common driver.

Finally, Qgc is the p-channel FET of the sustain electrode common driver for making the sources of n-channel FETs N1-N40 of the sustain electrode drivers the ground potential, and Qsc is the n-channel FET of the sustain electrode common driver for making the sources of p-channel-FETs P1-P40 of the sustain electrode drivers −Vs.

The operation of the PDP drive circuit that includes the self-recovering charge recovery circuit shown in FIG. 20 is next explained.

Charge recovery is basically performed at the time of applying the sustain erase pulse and the sustain pulse.

When a sustain erase pulse is applied to the first scan line, for example, switch FET Qe1, which is connected to a constant current element, is turned ON, and the potential of scan electrode Sc1 is gradually lowered at a fixed potential gradient to −Vs by way of the diode that is connected in parallel to p-channel FET P1 of the scan electrode driver.

After the potential of scan electrode Sc1 reaches −Vs, switch FET Qe1 is turned OFF, n-channel FET Qer1 of charge recovery circuit 51 is turned ON, and the charge stored in the display cell is recovered to the display cell itself by way of inductor L1, diode Dps1, and n-channel FET N1 of the scan electrode driver. Operation at this time moves the potential of scan electrode Sc1 toward the ground potential, but the potential does not actually reach the ground potential due to loss brought about by the impedance of the circuit and wiring.

After, or immediately before, charge recovery by way of inductor L1 ends, p-channel FET Qgs of the scan electrode common driver is turned ON, and the potential of scan electrode Sc1 is fixed at the ground potential through diode Dps1 and n-channel FET N1 of the scan electrode driver.

Meanwhile, the potential of sustain electrode Su1 before the sustain erase is fixed at −Vs, and n-channel FET Qsc of the sustain electrode common driver is in an ON state. Accordingly, turning OFF n-channel FET Qsc and turning ON n-channel FET Qer2 of charge recovery circuit 51 immediately before sustain erase causes the charge stored in the display cell to be recovered by the display cell itself by way of inductor L2, diode Dpc1, and n-channel FET N1 of the sustain electrode driver. Operation at this time causes the potential of sustain electrode Su1 to approach the ground potential, but loss brought about by the impedance of the circuit and wiring prevents the potential from reaching the ground potential.

Either after or immediately before charge recovery ends by way of inductor L2, p-channel FET Qgc of the sustain electrode common driver is turned ON, and sustain electrode Su1 is fixed at the ground potential through diode Dpc1 and n-channel FET N1 of the sustain electrode driver.

Subsequently, p-channel FET Qgc of the sustain electrode common driver is turned OFF immediately before the next set-up discharge period, immediately following which, switch FETs Qpe1 and Qgc1 of the sustain electrode driver are each turned ON.

The second set-up discharge pulse is output to sustain electrode Suk (k=1-40), which is paired with scan electrode Sck, to which the first set-up discharge pulse was applied in the set-up discharge period, and the potential of sustain electrode Suk is fixed at −Vp2 by turning ON the n-channel FET of the corresponding sustain electrode driver.

In sustain electrodes other than the sustain electrode that corresponds to the above-described n-channel FET, which is in an ON state, the paired p-channel FETS are turned ON, and the potential of these sustain electrodes is therefore fixed to the ground potential.

A sustain pulse is next applied by means of charge recovery using LC resonance to a scan electrode to which the sustain erase pulse is not applied, i.e., to a scan electrode Scj (j=1-40) to which a sustain pulse is selectively applied.

If the scan electrode to which the sustain pulse is applied is Sc40, for example, turning ON n-channel FET N40, which is connected to scan electrode Sc40, and switch FET Qr1 of the corresponding scan electrode driver causes the charge that is stored in the display cell to be recovered by the display cell itself through n-channel FET N40, switch FET Qr1, and inductor L3.

The scan electrode driver therefore attempts to output the sustain erase pulse to scan electrode Sc40, but scan electrode Sc40 is forcibly biased to −Vs at a slope of $\delta\ (L3 \cdot Cp)^{1/2}$ (Cp being the load capacitance). Since the number of scan electrodes to which the sustain pulse is applied changes over time, the value of inductor L3 can be varied or switched to keep the gradient of the rise of the sustain pulse at a uniform gradient. Inductor L3 may also be a fixed value if the change in rise gradient of the sustain pulse due to changes in the number of scan electrodes to which sustain pulses are applied remains within a permissible range in terms of characteristics.

However, the scan electrode driver operates to fix the potential of scan electrode Sc40 at −Vs, but −Vs is not attained due to loss that occurs due to the impedance of the circuit and wiring.

Nevertheless, either after or immediately before the completion of charge recovery by inductor L3, n-channel FET Qs1 of the switch unit is turned ON and the potential of scan electrode Sc40 is fixed at −Vs.

After the passage of a prescribed time interval following fixing of the potential of scan electrode Sc40 to −Vs, n-channel FET N40, which is connected to scan electrode Sc40, and n-channel FET Qr1 of the switch unit are turned OFF, and n-channel FET Qer1 of charge recovery circuit 51 is turned ON to cause the display cell itself to recover the charge stored in the display cell through inductor L1, diode Dps1, and n-channel FET N40 of the scan electrode driver. Operation at this time moves the potential of scan electrode Sc40 toward the ground potential, but the ground potential is not attained due to the occurrence of loss resulting from the impedance of the circuit and wiring.

However, either after or immediately before the end of charge recovery by inductor L1, p-channel FET Qgs of the scan electrode common driver is turned ON, and scan electrode Sc40 is fixed to the ground potential through diode Dps1 and n-channel FET N40 of the scan electrode driver.

The PDP drive circuit shown in FIG. 21 is a configuration in which a charge-storing type charge recovery circuit is added to the drive circuit of the first embodiment shown in FIG. 10.

As shown in FIG. 21, the drive circuit of this embodiment that has been provided with charge-storing type charge recovery circuits is a configuration in which first charge recovery circuit 61 is connected to the power supply line for supplying power to scan electrodes and second charge recovery circuit 62 is connected to the power supply line for supplying power to sustain electrodes.

First charge recovery circuit 61 is made up of: diode D31 and n-channel FET Qns connected in a series to inductor L11; diode D32 and p-channel FET Qps connected in a series to inductor L12; inductor L13 having a variable inductance value; and first charge storing capacitor Cs that stores charge that is recovered from display cells by way of scan electrodes. One end of inductor L13 is connected in common to the source of n-channel FET Qns and the drain of p-channel FET Qps, and the other end of inductor L13 is connected to each of the sources of n-channel FETs Qr1-Qr12 belonging to the switch units of each of the scan electrode drivers.

Second charge recovery circuit 62 is made up of: diode D33 and p-channel FET Qpc connected in a series to inductor L14; diode D34 and n-channel FET Qnc connected in a series to inductor L15; and second charge-storing capacitor Cc that stores charge that is recovered from display cells by way of sustain electrodes.

As shown in FIG. 21, p-channel FETs P1-P40 and n-channel FETs N1-N40 make up the drive unit of each scan electrode driver and sustain electrode driver. In addition, switch FETs Qe1-Qe12 are connected in a series to the constant-current elements of the scan electrode drivers; switch FETs Qpr1-Qpr12 are connected in a series to power supply Vp1 for the first set-up discharge pulse; switch FETs Qb1-Qb12 are connected in a series to power supply −Vbw for the scan base pulse; switch FETs Qgs1-Qgs12 are for making the sources of p-channel FETs P1-P40 of each scan electrode the ground potential; switch FETs Qw1-Qw12 are for making the sources of n-channel FETs N1-N40 of each scan electrode driver the ground potential; and switch FETs Qs1-Qs12 are connected in a series with power supply voltage −Vs for sustain pulses.

Further, diodes Dns1-Dns12 connect the sources of p-channel FETs P1-P40 of the scan electrode drivers to the scan electrode common driver; and diodes Dps1-Dps12 connect the sources of n-channel FETs N1-N40 to the scan electrode common driver.

Finally, p-channel FET Qgs of the scan electrode common driver is for making the sources of n-channel FETs N1-N40 of the scan electrode drivers the ground potential; and n-channel FET Qss of the scan electrode common driver is for making the sources of p-channel FETs P1-P40 of the scan electrode drivers −Vs.

Similarly, switch FETs Qpe1-Qpe12 are connected in a series with power supply −Vp2 for the second set-up discharge pulse of the sustain electrode drivers; and switch FETs Qcg1-Qgc12 are for making the sources of p-channel FETs P1-P40 of the sustain electrode drivers the ground potential.

Diodes Dnc1-Dnc12 connect the sources of p-channel FETs P1-P40 of the sustain electrode drivers to the sustain electrode common driver; and diodes Dpc1-Dpc12 connect the sources of n-channel FETs N1-N40 to the sustain electrode common driver.

Further, p-channel FET Qgc of the sustain electrode common driver is for making the sources of n-channel FETs N1-N40 of the sustain electrode drivers the ground potential, and n-channel FET Qsc of the sustain electrode common driver is for making the sources of p-channel FETs P1-P40 of the sustain electrode drivers voltage −Vs.

The operation of the drive circuit that is provided with the charge-storing type of charge recovery circuit shown in FIG. 21 is next explained.

As with the above-described self-recovering type of charge recovery circuit, charge recovery is carried out at the time of applying sustain erase pulses and at the time of applying sustain pulses.

In a case in which a sustain erase pulse is applied to the first scan line, for example, switch FET Qe1, which is connected to a constant-current element, is turned ON, and scan electrode Sc1 is gradually lowered to −Vs by a fixed potential gradient through the diode that is connected in parallel to p-channel FET P1 of the scan electrode driver.

After the potential of scan electrode Sd1 reaches −Vs, switch FET Qe1 is turned OFF, and p-channel FET Qps of first charge recovery circuit 61 is turned ON. Since the charge that was recovered through the immediately preceding sustain discharge is stored in first charge-storing capacitor Cs at this time, operation is performed such that the charge that is stored in first charge storing capacitor Cs is supplied to the display cell by way of inductor L12, diode Dps1, and n-channel FET N1 of the scan electrode driver; and scan electrode Sc1 is fixed to the ground potential. However, loss occurs due to the impedance of the circuit and wiring, and the potential of scan electrode Sc1 therefore fails to reach the ground potential by the amount of this loss.

In this regard, either after or immediately before the end of charge recovery though inductor L12, p-channel FET Qgs of the scan electrode common driver is turned ON to fix scan electrode Sd1 to the ground potential through diode Dps1 and n-channel FET N1 of the scan electrode driver.

Before sustain erase, the potential of sustain electrode Su1 is fixed to −Vs, and n-channel FET Qsc of the sustain electrode common driver is in an ON state. Accordingly, when n-channel FET Qsc is turned OFF and p-channel FET Qpc of second charge recovery circuit 62 is turned ON immediately before sustain erase, the charge recovered through the immediately preceding sustain discharge is stored in second charge-storing capacitor Cc, and operation is therefore performed to supply the charge that was stored in first charge-storing capacitor Cs to the display cell by way of inductor L14, diode Dpc1, and n-channel FET N1 of the sustain electrode driver, and to fix sustain electrode Su1 to the ground potential. Since loss occurs due to the impedance of the circuit and wiring, however, the potential of sustain electrode Su1 does not reach the ground potential.

In this regard, either after or immediately before the end of charge recovery by way of inductor L14, p-channel FET Qgc of the sustain electrode common driver is turned ON and sustain electrode Su1 is fixed to the ground potential through diode Dpc1 and n-channel FET N1 of the sustain electrode driver.

Next, p-channel FET Qgc of the sustain electrode common driver is turned OFF immediately before the next set-up discharge period, immediately following which, switch FETs Qpe1 and Qgc1 of the sustain electrode driver are each turned ON.

Since the second set-up discharge pulse is to be output to sustain electrode Suk (k=1-40) which is paired with scan electrode Sck (k=1-40) to which the first set-up discharge pulse is applied in the set-up discharge period, the potential of sustain electrode Suk is fixed to −Vp2 by turning ON the n-channel FET of the corresponding sustain electrode driver.

Since the paired p-channel FETs are ON in sustain electrodes other than the sustain electrode corresponding to the above-described n-channel FET that is in an ON state, the potential of these sustain electrodes is fixed to the ground potential.

As for scan electrodes to which the sustain erase pulse is not applied, i.e., a scan electrode Scj (j=1-40) to which a sustain pulse is selectively applied, the sustain pulse is applied by means of charge recovery using LC resonance.

In a case in which Sc40 is the scan electrode to which a sustain pulse is applied, for example, the charge that is stored in the display cell is recovered at first charge-storing capacitor Cs through n-channel FET N40, switch FET Qr1, and inductor L13 by turning ON n-channel FET N40, which is connected to scan electrode Sc40, and switch FET Qr1 of the corresponding scan electrode driver.

The scan electrode driver thus attempts to output a sustain erase pulse to scan electrode Sc40, but scan electrode Sc40 is forcibly biased to −Vs at a slope of $\delta(L13 \cdot Cp)^{1/2}$ (Cp being the load capacitance). Since the number of scan electrodes to which a sustain pulse is applied changes over time, the value of inductor L13 can be either varied or switched so that the rise gradient of the sustain pulse is kept uniform.

Inductor L13 may also have a fixed value if the variation in the rise gradient of the sustain pulse that is caused by change in the number of scan electrodes to which a sustain pulse is applied stays within a permissible range in regard to characteristics.

Operation is performed to fix the potential of scan electrode Sc40 at −Vs, but the potential does not reach −Vs due to the occurrence of loss caused by impedance of the circuit and wiring.

In this regard, n-channel FET Qs1 of the switch unit is turned ON either after or immediately before the end of charge recovery by inductor L13 to fix the potential of scan electrode Sc40 at −Vs.

After the passage of a prescribed time period following fixing the potential of scan electrode Sc40 at −Vs, n-channel FET N40, which is connected to scan electrode Sc40, and n-channel FET Qr1 of the switch unit are turned OFF, and n-channel FET Qps of first charge recovery circuit 61 is turned ON.

At this time, the charge that was recovered through the immediately preceding sustain discharge is stored in first charge-storing capacitor Cs, and as a result, operation is performed to supply the charge that was stored in first charge storing capacitor Cs to the display cell through inductor L12, diode Dps1, and n-channel FET N40 of the scan electrode driver, and to fix scan electrode Sc40 to the ground potential. The occurrence of loss due to the impedance of the circuit and wiring, however, prevents the potential of scan electrode Sc40 from reaching the ground potential.

In this regard, p-channel FET Qgs of the scan electrode common driver is turned ON either after or immediately before the end of charge recovery by inductor L12 to fix the potential of scan electrode Sc40 to the ground potential through diode Dps1 and n-channel FET N40 of the scan electrode driver.

While preferred embodiments of the present invention have been described using specific terms, such description is for illustrative purposes only, and it is to be understood that changes and variations may be made without departing from the spirit or scope of the following claims.

What is claimed is:

1. A method of driving a plasma display panel, which is a mixed scan-sustain-type plasma display panel for displaying a desired image by carrying out each of set-up discharge, set-up discharge erase, write discharge, sustain discharge, and sustain discharge erase for each scan line of a plurality of scan lines of an AC plasma display panel that is made up of a plurality of display cells arranged in a lattice and includes a plurality of pairs of a scan electrode and a sustain electrode for the respective scan lines; said method comprising the steps of:

performing said set-up discharge by applying a set-up discharge pulse which is a gradually rising pulse to the scan electrode of said each scan line;

performing said sustain discharge by applying a sustain pulse to each of the scan electrodes and sustain electrodes of scan lines other than the scan line in which said sustain discharge erase is to be performed and other than the scan line in which the immediately preceding set-up discharge was performed; and carrying out said set-up discharge erase by applying, to the sustain electrode paired with the scan electrode to which said set-up discharge pulse was applied to thereby the immediately preceding set-up discharge, a set-up discharge erase pulse which is a gradually rising pulse of the same polarity as the sustain pulse that is applied to the scan electrode of that scan line.

2. The method of driving a plasma display panel according to claim 1, further comprising the steps of:

carrying out said sustain discharge erase by applying, to the sustain electrode of the scan line in which said sustain discharge erase is to be performed, a sustain erase pulse which is a gradually rising pulse of the same polarity as the sustain pulse that is applied to the scan electrode of the scan line.

3. The method of driving a plasma display panel according to claim 2, further comprising the step of:

carrying out said set-up discharge erase by applying, to the sustain electrode of the scan line in which the immediately preceding set-up discharge was performed, a set-up discharge erase pulse which is a gradually rising pulse of the same polarity as the sustain pulse that is applied to the scan electrode of that scan line.

4. The method of driving a plasma display panel according to claim 3 wherein said set-up discharge erase pulse and said sustain erase pulse have the same shape.

5. A drive circuit of a plasma display panel, which is mixed scan-sustain-type plasma display panel for displaying a desired image by carrying out each of set-up discharge, set-up discharge erase, write discharge, sustain discharge, and sustain discharge erase for each scan line of a plurality of scan lines of an AC plasma display panel that is made up of a plurality of display cells arranged in a lattice and includes a plurality of pairs of a scan electrode and a sustain electrode for the respective scan lines; said drive circuit comprising:

a scan electrode drive circuit for performing said set-up discharge by applying a set-up discharge pulse which is a gradually rising pulse to the scan electrode of said each scan line, and for carrying out said sustain discharge by applying sustain pulses to the scan electrodes of scan lines other than the scan line in which said sustain discharge erase is to be performed and other than the scan line in which the immediately preceding set-up discharge was performed; and a sustain electrode driving circuit for beth-carrying out said sustain discharge by applying sustain pulses to the sustain electrodes of scan lines other than the scan line in which said sustain discharge erase is to be performed and other than the scan line in which the immediately preceding set-up discharge was performed, as well as carrying out said set-up discharge erase by applying, to the sustain electrode paired with the scan electrode to which said set-up discharge pulse was applied to thereby perform the immediately preceding set-up discharge, a set-up discharge erase pulse which is a gradually rising pulse having the same polarity as the sustain pulse that is applied to the sustain electrodes of said scan lines.

6. The drive circuit of a plasma display panel according to claim 5, wherein said sustain electrode drive circuit carries out said sustain discharge erase by applying a sustain erase pulse which is a gradually rising pulse having the same polarity as the sustain pulse that is applied to sustain electrodes of said other scan lines, to the sustain electrode of the scan line in which said sustain discharge erase is to be performed.

7. The drive circuit of a plasma display panel according to claim 6, wherein said sustain electrode drive circuit carries out said set-up discharge erase by applying a set-up discharge erase pulse which is a gradually rising, pulse of the same polarity as the sustain pulse that was applied to the sustain electrodes of said other scan lines, to the sustain electrodes paired with the scan electrodes of the scan line in which the immediately preceding set-up discharge was performed.

8. The drive circuit for a plasma display panel according to claim 7 wherein said sustain electrode drive circuit outputs said set-up discharge erase pulse and said sustain erase pulse which have the same shape.

9. The drive circuit of a plasma display panel according to claim 5, wherein said sustain electrode drive circuit carries out said sustain discharge erase by applying, to the sustain electrode of the scan line in which said sustain discharge erase is to be performed, a sustain erase pulse which is a gradually rising pulse having the same polarity as the sustain pulse that is applied to the scan electrode of said scan line.

10. The drive circuit of a plasma display panel according to claim 9 wherein said sustain discharge drive circuit carries out said set-up discharge erase by applying a set-up discharge erase pulse which is a gradually rising pulse of the same polarity as the sustain pulse that is applied to scan electrodes, to the sustain electrode of the scan line in which the immediately preceding set-up discharge was performed.

11. The drive circuit of a plasma display panel according to claim 10 wherein said sustain electrode drive circuit outputs said set-up discharge erase pulse and said sustain erase pulse which have the same shape.

* * * * *

UNITED STATES PATENT AND TRADEMARK OFFICE

CERTIFICATE OF CORRECTION

PATENT NO. : 7,319,442 B2
APPLICATION NO. : 10/930950
DATED : January 15, 2008
INVENTOR(S) : Tadashi Nakamura It is certified that error appears in the above-identified patent and that said Letters Patent is hereby corrected as shown below:

Col. 19, line 24, insert “perform” after “thereby”

Signed and Sealed this

Tenth Day of February, 2009

JOHN DOLL
*Acting Director of the United States Patent and Trademark Office*